US008194111B2

(12) United States Patent
Ohno

(10) Patent No.: US 8,194,111 B2
(45) Date of Patent: Jun. 5, 2012

(54) LIGHT-EMITTING ELEMENT HEAD, LIGHT-EMITTING ELEMENT CHIP, IMAGE FORMING APPARATUS AND SIGNAL SUPPLY METHOD

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 491 days.

(21) Appl. No.: 12/427,913

(22) Filed: Apr. 22, 2009

(65) Prior Publication Data

US 2010/0118108 A1 May 13, 2010

(30) Foreign Application Priority Data

Nov. 10, 2008 (JP) ..... 2008-287649

(51) Int. Cl.
*B41J 2/45* (2006.01)

(52) U.S. Cl. ..... 347/238; 347/247

(58) Field of Classification Search ..... 347/238, 347/247, 249, 235, 237, 130
See application file for complete search history.

(56) References Cited

U.S. PATENT DOCUMENTS

| | | | | |
|---|---|---|---|---|
| 5,969,744 | A | 10/1999 | Sakashita et al. | |
| 6,559,879 | B1 * | 5/2003 | Kobayashi et al. | 347/238 |
| 7,954,917 | B2 * | 6/2011 | Inoue | 347/9 |
| 7,990,407 | B2 * | 8/2011 | Nagumo | 347/237 |
| 8,004,550 | B2 * | 8/2011 | Ohno | 347/237 |
| 8,098,271 | B2 * | 1/2012 | Tsuchiya | 347/238 |
| 2010/0177155 | A1 * | 7/2010 | Kii | 347/224 |
| 2011/0164103 | A1 * | 7/2011 | Kii | 347/118 |

FOREIGN PATENT DOCUMENTS

| | | |
|---|---|---|
| EP | 2006918 | 12/2008 |
| JP | 2001-219596 | 8/2001 |
| JP | 2004-181741 | 7/2004 |
| WO | 2007/097347 | 8/2007 |

* cited by examiner

*Primary Examiner* — Julian Huffman
*Assistant Examiner* — Sharon A Polk
(74) *Attorney, Agent, or Firm* — Fildes & Outland, P.C.

(57) ABSTRACT

The light-emitting element head is provided with: plural light-emitting element chips in each of which light-emitting elements are arrayed in a line; a lighting signal supply unit supplying lighting signals for setting whether or not the light-emitting elements emit light, each of the lighting signals being provided in common to the light-emitting element chips that belong to one of N groups into which the plural light-emitting element chips are divided, where N is an integer of 2 or more; and a clock signal supply unit supplying a first clock signal as a transfer signal for causing the light-emitting elements to sequentially emit light, and second clock signals for setting the light-emitting elements ready to emit light, the second clock signals being different from one another, being supplied to the respective light-emitting element chips belonging to the one of the N groups, and being supplied in common across the N groups.

9 Claims, 10 Drawing Sheets

| PERIOD | φ2_1 | φ2_2 |
|---|---|---|
| t1 | L | H |
| t2 | L | L |
| t3 | H | L |
| t4 | H | H |

| PERIOD | φ2_1 | φ2_2 | φ2_3 |
|---|---|---|---|
| t1 | L | H | H |
| t2 | H | L | H |
| t3 | L | L | H |
| t4 | H | H | L |
| t5 | L | H | L |
| t6 | H | L | L |
| t7 | L | L | L |
| t8 | H | H | H |

LIGHT-EMITTING ELEMENT HEAD, LIGHT-EMITTING ELEMENT CHIP, IMAGE FORMING APPARATUS AND SIGNAL SUPPLY METHOD

CROSS REFERENCE TO RELATED APPLICATIONS

This application is based on and claims priority under 35 USC §119 from Japanese Patent Application No. 2008-287649 filed Nov. 10, 2008.

BACKGROUND

1. Technical Field

The present invention relates to a light-emitting element head, a light-emitting element chip, an image forming apparatus and a signal supply method.

2. Related Art

In an electrophotographic image forming apparatus such as a printer, a copy machine or a facsimile machine, an image is formed on a recording paper sheet as follows. Firstly, an electrostatic latent image is formed on a charged photoconductor by causing an optical recording unit to emit light on the basis of image information. Then, the electrostatic latent image is made visible by being developed with toner. Lastly, the toner image is transferred on and fixed to the recording paper sheet. As such an optical recording unit, in addition to an optical-scanning recording unit that performs exposure by laser scanning in a first scan direction using a laser beam, an optical recording unit using the following light-emitting element head has been employed in recent years. This light-emitting element head includes a large number of light-emitting element chips arrayed in a first scan direction, and each light-emitting element chip includes a light-emitting element array formed of light-emitting elements such as light emitting diodes (LEDs) arrayed in a line.

Such a light-emitting element head including a large number of light-emitting element arrays requires as many lighting signals for light-emitting elements as the number of light-emitting element chips. Accordingly, the number of signal bus lines for the light-emitting element heads increases with increase in the number of light-emitting element chips, and this complicates the routing of the signal bus lines. In addition, the larger number of current buffer circuits each having a large current drive capability is required with increase in the number of light-emitting element chips since the lighting signals supply a current to the light-emitting elements.

SUMMARY

According to an aspect of the present invention, there is provided a light-emitting element head including: plural light-emitting element chips in each of which light-emitting elements are arrayed in a line; a lighting signal supply unit supplying lighting signals for setting whether or not the light-emitting elements emit light, each of the lighting signals being provided in common to the light-emitting element chips that belong to one of N groups into which the plural light-emitting element chips are divided, where N is an integer of 2 or more; and a clock signal supply unit supplying a first clock signal as a transfer signal for causing the light-emitting elements to sequentially emit light, and second clock signals for setting the light-emitting elements ready to emit light, the second clock signals being different from one another, being supplied to the respective light-emitting element chips belonging to the one of the N groups, and being supplied in common across the N groups.

BRIEF DESCRIPTION OF THE DRAWINGS

Exemplary embodiment (s) of the present invention will be described in detail based on the following figures, wherein.

DETAILED DESCRIPTION

Hereinafter, a detail description will be given of exemplary embodiments of the present invention with reference to the attached drawings.

Figure 1:
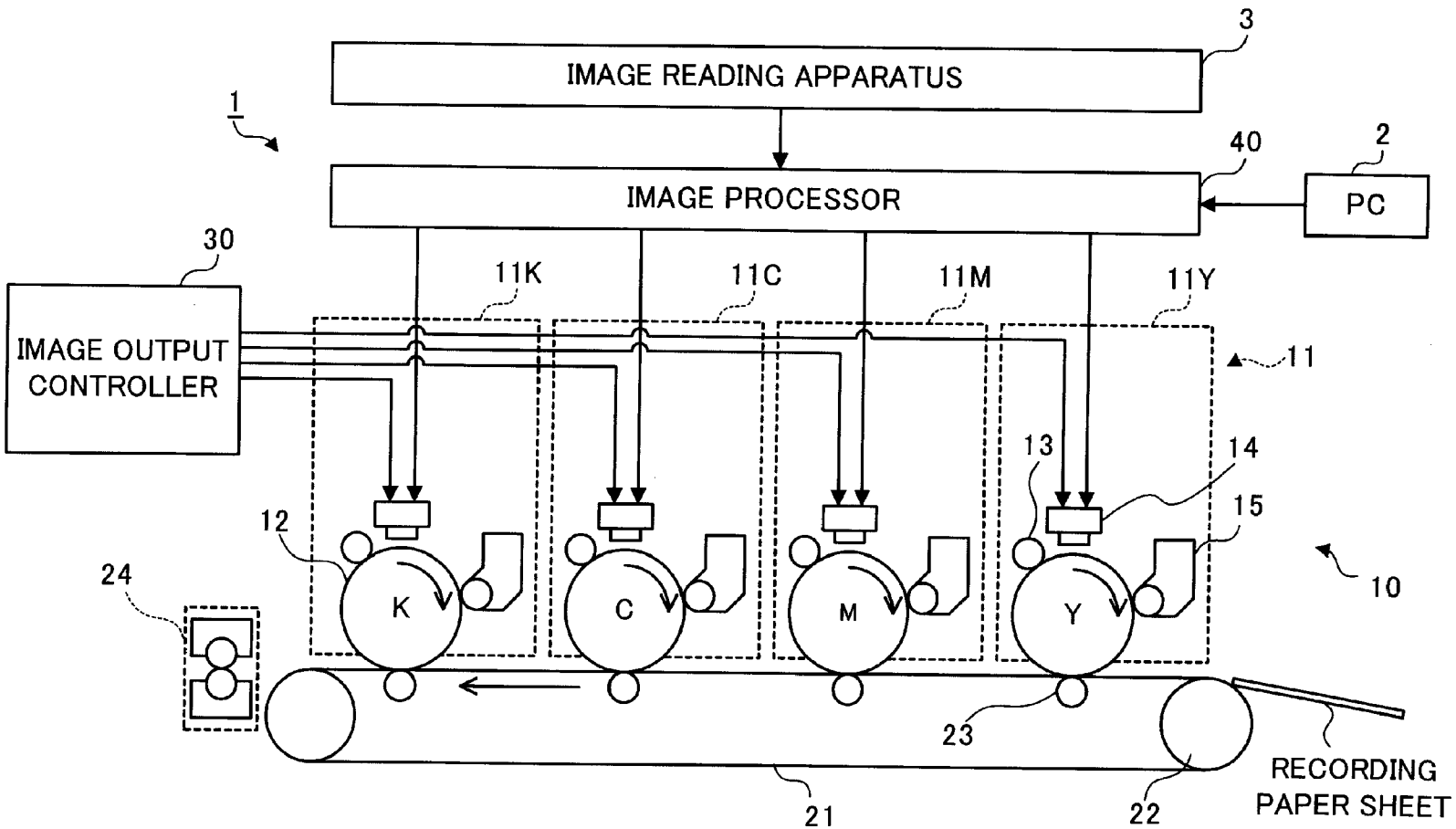
FIG. 1 shows an overall configuration of an image forming apparatus to which the exemplary embodiment is to be applied.

FIG. 1 shows an overall configuration of an image forming apparatus 1 to which the exemplary embodiment is to be applied.

The image forming apparatus 1 shown in FIG. 1 is generally called a tandem type image forming apparatus and the image forming apparatus 1 includes an image processing system 10, an image output controller 30 and an image processor 40. The image processing system 10 forms an image in accordance with different color tone datasets. The image output controller 30 controls the image processing system 10. The image processor 40, which is connected to devices such as a personal computer (PC) 2 and an image reading apparatus 3, performs predetermined image processing on image data received from the above devices.

The image processing system 10 includes image forming units 11. The image forming units 11 are formed of multiple engines arranged in parallel at intervals in the horizontal direction. Specifically, the image forming units 11 are composed of four units: a yellow (Y) image forming unit 11Y, a magenta (M) image forming unit 11M, a cyan (C) image forming unit 11C and a black (K) image forming unit 11K. Each image forming unit 11 includes a photoconductive drum 12, a charging device 13, an exposure device 14 and a developing device 15. On the photoconductive drum 12 as an example of an image carrier (photoconductor), an electrostatic latent image is formed and thus a toner image is formed. The charging device 13 as an example of a charging unit uniformly charges the outer surface of the photoconductive drum 12. The exposure device 14 as an example of an exposure unit exposes the photoconductive drum 12 charged by the charging device 13. The developing device 15 as an example of a developing unit develops a latent image formed by the exposure device 14. In addition, the image processing system 10 further includes a paper sheet transport belt 21, a drive roll 22 and transfer rolls 23. The paper sheet transport belt 21 transports a recording paper sheet so that color toner images respectively formed on the photoconductive drums 12 of the image forming units 11Y, 11M, 11C and 11K are transferred on the recording paper sheet by multilayer transfer. The drive roll 22 drives the paper sheet transport belt 21. Each transfer roll 23 as an example of a transfer unit transfers the toner image formed on the corresponding photoconductive drum 12 onto a recording paper sheet.

The image processor 40 performs image processing on image data input from the PC 2 and the image reading apparatus 3, and resultant data is supplied to the image forming units 11Y, 11M, 11C and 11K through an interface (not shown in the figure). The image processing system 10 operates on the basis of a synchronizing signal and the like supplied by the image output controller 30. For example, in the yellow image forming unit 11Y, on the basis of image signals supplied from the image processor 40, the exposure device 14 forms an electrostatic latent image on the outer surface of the photoconductive drum 12 charged by the charging device 13. Then, the developing device 15 forms a yellow toner image from the formed electrostatic latent image. By using the corresponding transfer roll 23, the yellow image forming unit 11Y transfers the formed yellow toner image on a recording paper sheet on the paper sheet transport belt 21 that rotates in the direction indicated by an arrow in FIG. 1. Then, magenta, cyan and black toner images are respectively formed on the photoconductive drums 12 dedicated thereto. After that, by using the corresponding transfer rolls 23, these color toner images are transferred by multilayer transfer on the recording paper sheet transported on the paper sheet transport belt 21. Then, the recording paper sheet is transported to a fixing device 24, which heats and presses to fix the toner images transferred by multilayer transfer on the recording paper sheet.

Figure 2:
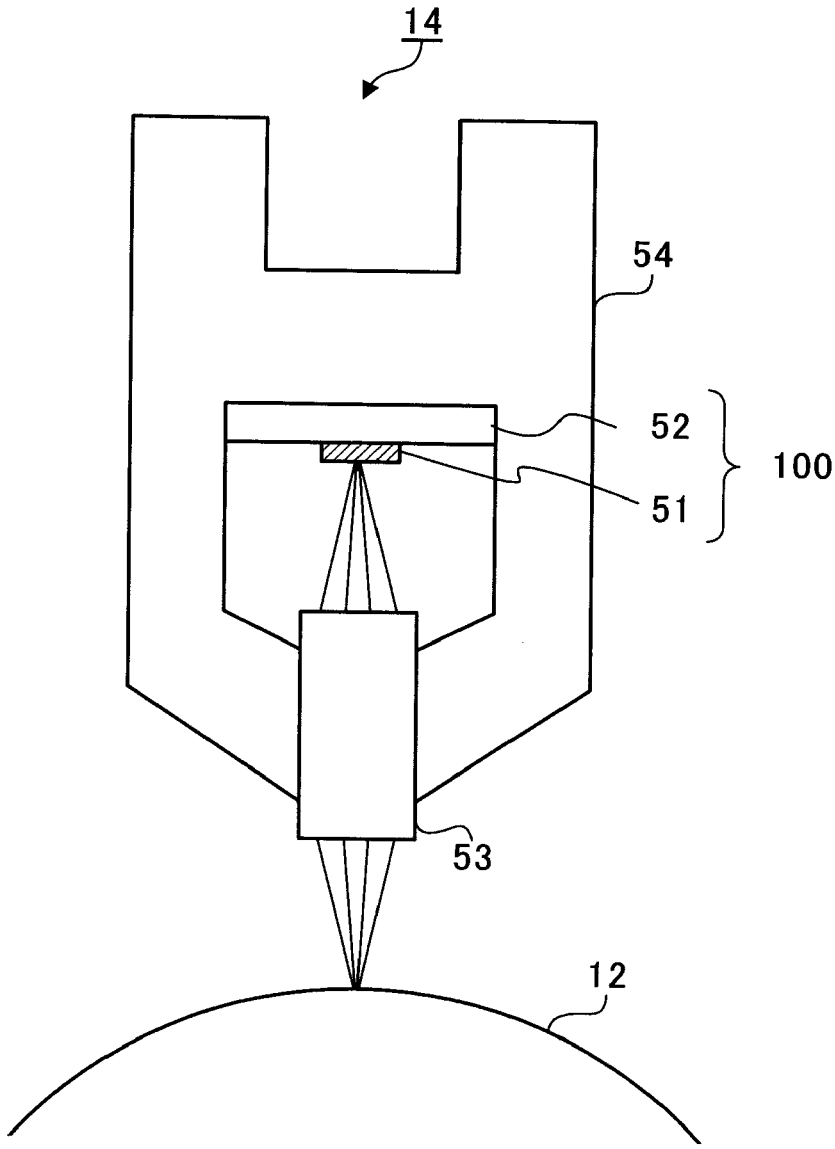
FIG. 2 shows a structure of the exposure device to which the exemplary embodiment is to be applied.

FIG. 2 shows a structure of the exposure device 14 to which the exemplary embodiment is to be applied. The exposure device 14 includes light-emitting element chips 51, a printed circuit board 52 and a rod lens array 53. Each light-emitting element chip 51 includes multiple light-emitting elements arrayed in a line. The printed circuit board 52 supports the light-emitting element chips 51. In addition, a circuit that performs drive control on the light-emitting element chips 51 is mounted on the printed circuit board 52. The rod lens array 53, which is an optical element, focuses a light output emitted by the light-emitting elements onto the photoconductive drum 12. The printed circuit board 52 and the rod lens array 53 are held by a housing 54. On the printed circuit board 52, multiple light-emitting element chips 51 are arrayed so that as many light-emitting elements as the number of pixels are arrayed in the first scan direction. For example, suppose the case where the shorter side (297 mm) of an A3-size recording paper sheet is set as a first scan direction, and where the resolution is 600 dpi. In this case, 7040 light-emitting elements are arrayed on the printed circuit board 52 at intervals of 42.3 μm. Note that, actually in the exemplary embodiment, 7680 light-emitting elements are arrayed on the printed circuit board 52 in consideration of side-to-side misregistration and the like. Hereinbelow, the light-emitting element chips 51 and the printed circuit board 52 will be collectively referred to as a light-emitting element head 100.

Figure 3A:
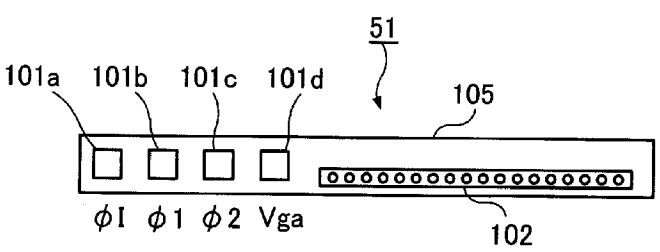
FIG. 3A is a schematic view for explaining a structure of each light-emitting element chip.

FIG. 3A is a schematic view for explaining a structure of each light-emitting element chip 51. The light-emitting element chip 51 includes a substrate 105, a light-emitting element array 102, a lighting-signal terminal 101*a*, a first clock-signal terminal 101*b*, a second clock-signal terminal 101*c* and a power supply terminal 101*d*. The light-emitting element array 102 is formed of light-emitting elements arrayed in a line at equal intervals along a longer side of the rectangular substrate 105. To the lighting-signal terminal 101*a*, lighting signals ϕI for setting whether or not the light-emitting elements of the light-emitting element array 102 emit light are supplied. To the first clock-signal terminal 101*b*, a first clock signal ϕ1 serving as a transfer signal for causing the light-emitting elements of the light-emitting element array 102 to sequentially emit light is supplied. To the second clock-signal terminal 101*c*, second clock signals ϕ2 for setting the light-emitting elements ready to emit light are supplied. To the power supply terminal 101*d*, a power supply voltage Vga is supplied.

Figure 3B:
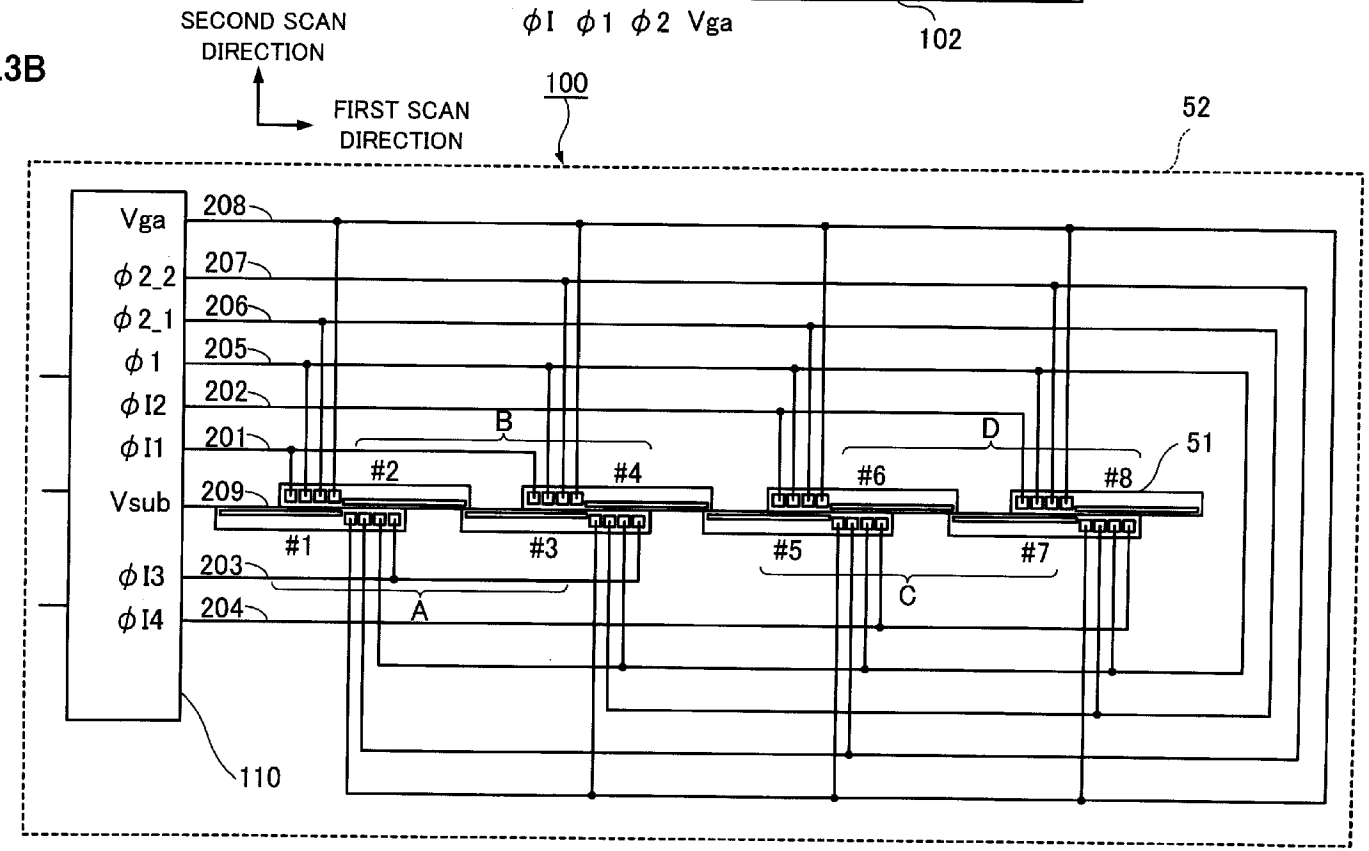
FIG. 3B is a schematic view for explaining a configuration of the light-emitting element head.

FIG. 3B is a schematic view for explaining a configuration of the light-emitting element head 100. The light-emitting element head 100 includes the printed circuit board 52, the multiple light-emitting element chips 51 on the printed circuit board 52, and a signal generating circuit 110. The signal generating circuit 110, which is an example of a clock signal supply unit and a lighting signal supply unit, supplies the multiple light-emitting element chips 51 with signals (control signals) for controlling a light-emitting operation of the light-emitting elements. FIG. 3B shows, as an example, the light-emitting element head 100 equipped with eight light-emitting element chips 51 (#1 to #8). The eight light-emitting element chips 51 are arrayed in a zigzag pattern in which each adjacent two of the light-emitting element chips 51 are faced each other so that the light-emitting elements are arrayed in a line with equal intervals in the light-emitting element head 100.

In the present exemplary embodiment, the eight light-emitting element chips 51 are divided into four groups each formed of two light-emitting element chips 51, as an example. Specifically, the four groups are: an A group of #1 and #3 of the light-emitting element chips 51; a B group of #2 and #4; a C group of #5 and #7; and a D group of #6 and #8. These light-emitting element chips 51 have the same structure.

From image signals (not shown in the figure) supplied by the image processor 40, and the synchronizing signal and the like (not shown in the figure) supplied by the image output controller 30 in the image forming apparatus 1, the signal generating circuit 110 generates the control signals for controlling a light-emitting operation of the light-emitting elements in the light-emitting element chips 51. The control signals are the first clock signal ϕ1 serving as a transfer signal for causing the light-emitting elements to sequentially emit light by self scanning, the second clock signals ϕ2 for setting the light-emitting elements ready to emit light, and the lighting signals ϕI for setting whether or not the light-emitting elements emit light on a single light-emitting element basis.

In this example, two second clock signals ϕ2 different from each other, that is, a 2_1-th clock signal ϕ2_1 and a 2_2-th clock signal ϕ2_2, are used. Meanwhile, four lighting signals ϕI, that is, a first lighting signal ϕI1, a second lighting signal ϕI2, a third lighting signal ϕI3 and a fourth lighting signal ϕI4, are used.

The signal generating circuit 110 supplies the first clock signal ϕ1 to the first clock-signal terminals 101*b* of all the light-emitting element chips 51 in common through a first clock-signal bus line 205.

The signal generating circuit 110 supplies the 2__1-th clock signal ϕ2_1 to the second clock-signal terminals 101*c* of #2, #3, #6 and #7 of the light-emitting element chips 51, which belong to the groups different from one another, through a 2__1-th clock-signal bus line 206. Meanwhile, the signal generating circuit 110 supplies the 2__2-th clock signal ϕ2_2 to the second clock-signal terminals 101*c* of #1, #4, #5 and #8 of the light-emitting element chips 51, which belong to different groups from one another, through a 2__2-th clock-signal bus line 207.

In other words, the signal generating circuit 110 supplies the second clock signals ϕ2, which are different from each other, even to the respective light-emitting element chips 51 belonging to the same group, while supplying one of the second clock signals ϕ2 in common to the light-emitting element chips 51 respectively belonging to the groups different from one another.

The signal generating circuit 110 supplies the first lighting signal ϕI1 to the lighting-signal terminals 101*a* of #2 and #4 of the light-emitting element chips 51, which belong to the B group, through a first lighting signal bus line 201, while supplying the second lighting signal ϕI2 to the lighting-signal terminals 101*a* of #6 and #8 of the light-emitting element chips 51, which belong to the D group, through a second lighting signal bus line 202. The signal generating circuit 110 supplies the third lighting signal ϕI3 to the lighting-signal terminals 101*a* of #1 and #3 of the light-emitting element chips 51, which belong to the A group, through a third lighting signal bus line 203, while supplying the fourth lighting signal ϕI4 to the lighting-signal terminals 101*a* of #5 and #7 of the light-emitting element chips 51, which belong to the C group, through a fourth lighting signal bus line 204.

In other words, the signal generating circuit 110 supplies one of the lighting signals ϕI in common to the light-emitting element chips 51 in each group.

In addition, the signal generating circuit 110 supplies the power supply voltage Vga to the power supply terminals 101*d* of all the light-emitting element chips 51 through a power supply bus line 208. Moreover, the signal generating circuit 110 supplies a reference voltage Vsub to backside common electrodes 81 respectively formed on back sides of the substrates 105 of all the light-emitting element chips 51 through a reference voltage bus line 209.

In the light-emitting element head 100 of the present exemplary embodiment, the total number of signal bus lines, which do not include the power supply bus line 208 and the reference voltage bus line 209, is seven, that is, the signal bus lines for supplying the first clock signal ϕ1, the 2__1-th clock signal ϕ2_1, the 2__2-th clock signal ϕ2_2, and the first to fourth lighting signals ϕI1 to ϕI4.

By contrast, in the case of driving the eight light-emitting element chips 51 without grouping, a single second clock signal ϕ2 may be used in common for the light-emitting element chips 51, but the lighting signals ϕI are needed respectively for the eight light-emitting element chips 51. Thus, in this case, the total number of signal bus lines is ten, that is, the signal bus lines for supplying the first clock signal ϕ1, the second clock signals ϕ2 and the eight lighting signals ϕI for the respective light-emitting element chips 51.

In other words, by driving the multiple light-emitting element chips 51 in groups in the light-emitting element head 100, the number of signal bus lines for the second clock signals ϕ2 is increased, but the number of signal bus lines for the lighting signals ϕI is reduced. Thus, the total number of signal bus lines is reduced.

In addition, current buffer circuits each having a large current drive capability need to be provided in the signal generating circuit 110 since the first clock signal ϕ1, the second clock signals ϕ2 and the lighting signals ϕI supply a current for driving the light-emitting element chips 51. However, reduction in the number of signal bus lines also causes reduction in the number of current buffer circuits.

The signal generating circuit 110 may be an LSI such as an application specific integrated circuit (ASIC), for example.

Figure 4:
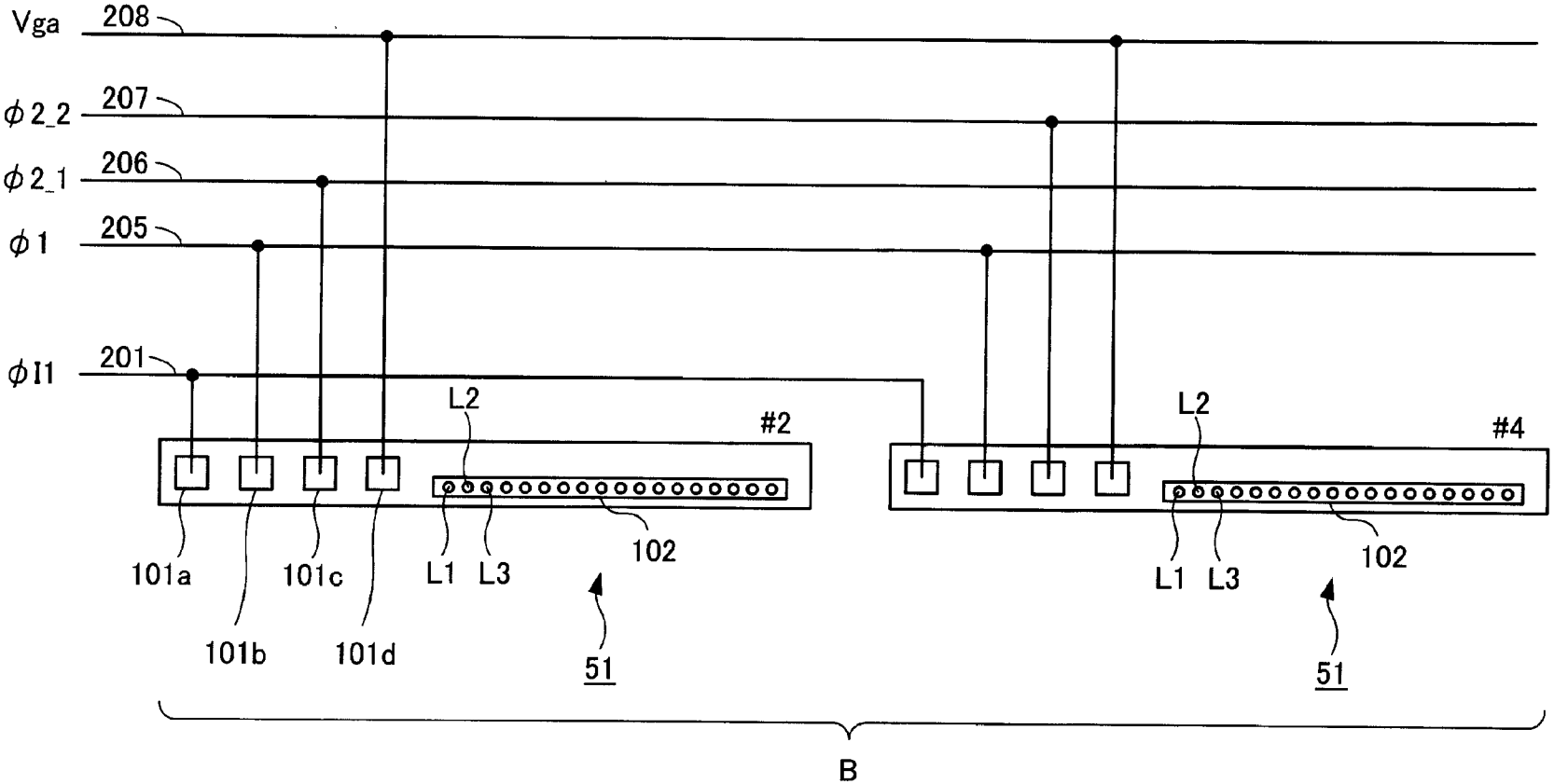
FIG. 4 is a partial enlarged view of the light-emitting element head.

FIG. 4 is a partial enlarged view focusing on one of the groups of the light-emitting element chips 51 included in the light-emitting element head 100. Specifically, FIG. 4 shows the B group (#2 and #4 of the light-emitting element chips 51) shown in FIG. 3B. In the light-emitting element array 102, light-emitting thyristors L1, L2, L3, . . . , which serve as the light-emitting elements, are arrayed in a line in this order. The connection relation between #2 and #4 of the light-emitting element chips 51, which belong to the B group, and the lines including the signal bus lines is as described in FIG. 3B.

The power supply voltage Vga is supplied in common to all the light-emitting element chips 51 irrespective of group. The first clock signal ϕ1 is supplied in common to all the light-emitting element chips 51 irrespective of group, too. The first lighting signal ϕI1 is supplied in common to the light-emitting element chips 51 (#2 and #4), which belong to the B group. Meanwhile, the different second clock signals ϕ2 (the 2__1-th and 2__2-th clock signals ϕ2_1 and ϕ2_2) are supplied respectively to #2 and #4 of the light-emitting element chips 51 belonging to the B group.

In other words, to each group, one of the lighting signals ϕI is supplied in common while the mutually different second clock signals ϕ2 are supplied.

Figure 5:
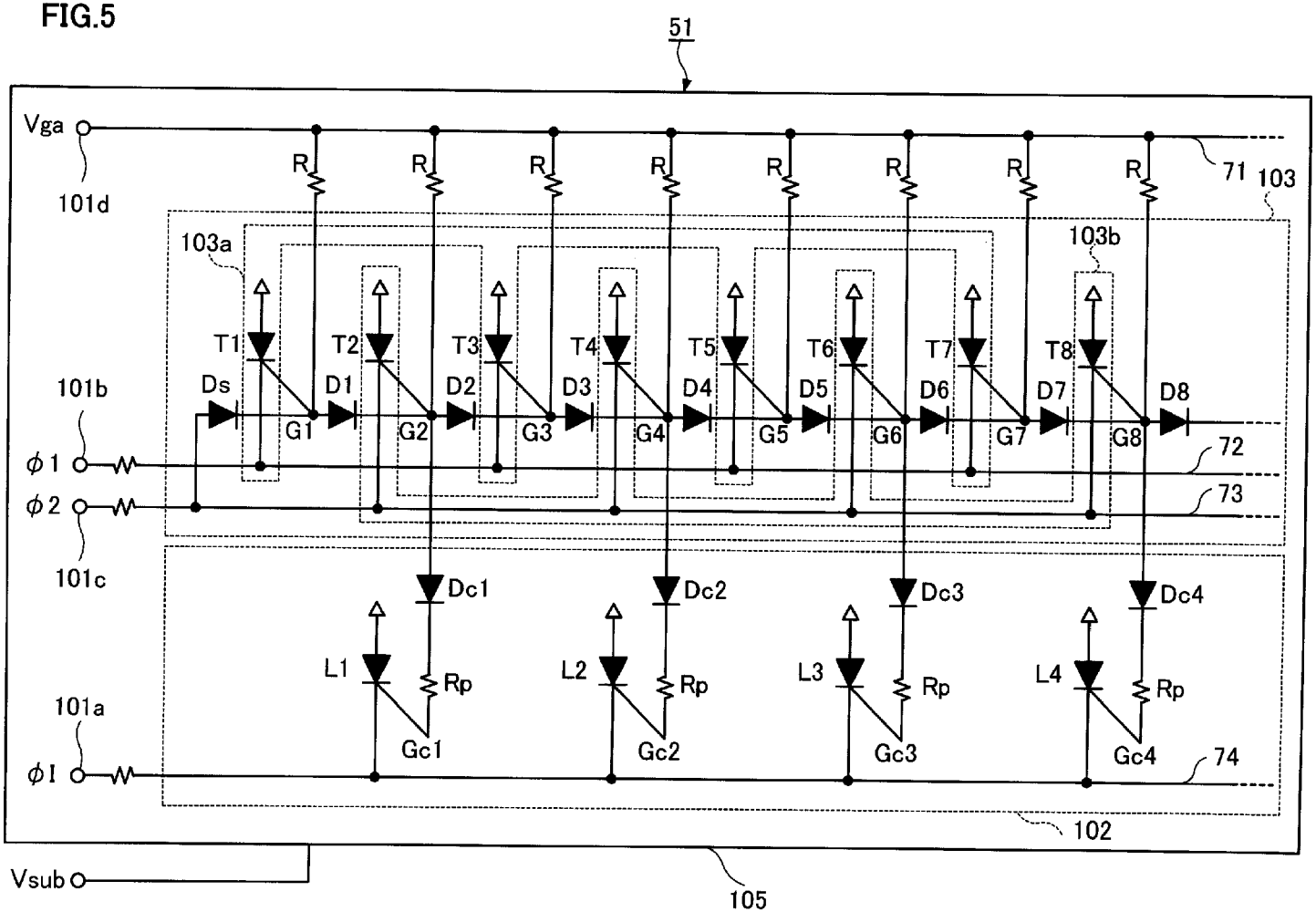
FIG. 5 shows an equivalent circuit of each light-emitting element chip using a self-scanning light-emitting element array in the exemplary embodiment.

FIG. 5 shows an equivalent circuit of each light-emitting element chip 51 using a self-scanning light-emitting element array in the exemplary embodiment. The self-scanning light-emitting element array of the light-emitting element chip 51 includes the substrate 105, the light-emitting element array 102 and a transfer element array 103. The light-emitting element array 102 is a one-dimensional array of the light-emitting thyristors L1, L2, L3, . . . , each of which is a three-terminal light-emitting element having an anode terminal, a cathode terminal and a gate terminal. The transfer element array 103 is an one-dimensional array of first transfer thyristors T1, T3, T5, . . . , and second transfer thyristors T2, T4, T6, . . . , and each of the first and second transfer thyristors is a three-terminal transfer element that has an anode electrode, a cathode electrode and a gate electrode. Specifically, the first transfer thyristors T1, T3, T5, . . . , are three-terminal transfer elements for causing the light-emitting thyristors L1, L2, L3, . . . , to sequentially emit light, while the second transfer thyristors T2, T4, T6, . . . , are three-terminal transfer elements for being sequentially turned on to set the light-emitting thyristors L1, L2, L3, . . . , ready to emit light. In the transfer element array 103 shown in FIG. 5, the first transfer thyristors T1, T3, T5, . . . , are odd-numbered thyristors enclosed by a dashed line 103*a*, while the second transfer thyristors T2, T4, T6, . . . , are even-numbered thyristors enclosed by a dashed line 103*b*.

Specifically, FIG. 5 shows a leading portion of the equivalent circuit, which includes four light-emitting thyristors L1, L2, . . . , L4 each having a pnpn structure in the light-emitting element array 102; and four first transfer thyristors T1, T3, . . . , T7 and four second transfer thyristors T2, T4, . . . , T8 each having a pnpn structure in the transfer element array 103.

The number of light-emitting thyristors in the self-scanning light-emitting element array of the present exemplary embodiment is half the total number of the first and second transfer thyristors.

Gate electrodes G1, G3, . . . , G7 of the first transfer thyristors T1, T3, . . . , T7 are connected to gate electrodes G2, G4, . . . , G8 of the second transfer thyristors T2, T4, . . . , T8 via connecting diodes D1, D3, . . . , D7, respectively. Specifically, each of the gate electrodes G1, G3, . . . , G7 of the respective first transfer thyristors T1, T3, . . . , T7 is connected to the adjacent one of the gate electrodes G2, G4, . . . , G8 of the respective second transfer thyristors T2, T4, . . . , T8. In addition, the gate electrodes G2, G4, . . . , G8 of the second transfer thyristors T2, T4, . . . , T8 are connected to the gate electrodes G3, G5, . . . , G9 (though G9 is not shown in the figure) of the first transfer thyristors T3, T5, . . . , T9 (though T9 is not shown in the figure) via connecting diodes D2, D4, . . . , D8, respectively. Specifically, each of the gate electrodes G2, G4, . . . , G8 of the respective second transfer thyristors T2, T4, . . . , T8 is connected to the adjacent one of the gate electrodes G3, G5, . . . , G9 of the respective first transfer thyristors T3, T5, . . . , T9. Note that each connecting diode is a diode causing a current to flow in one direction therein.

The connecting diode D1 is connected with its orientation set to allow a current to flow from the gate electrode G1 to the gate electrode G2. The other connecting diodes D2, D3, . . . , D8 are connected in the same manner.

In addition, the gate electrodes G2, G4, . . . , G8 of the second transfer thyristors T2, T4, . . . , T8 are connected to gate terminals Gc1, Gc2, . . . , Gc4 of the light-emitting thyristors L1, L2, . . . , L4 via pairs of coupling diodes Dc1, Dc2, . . . , Dc4 and resistors Rp, respectively. Here, each coupling diode is a diode causing a current to flow in one direction therein. The coupling diode Dc1 is connected with its orientation set to allow a current to flow from the gate electrode G2 to the gate terminal Gc1. The other coupling diodes Dc2, Dc3 and Dc4 are connected in the same manner.

The coupling diodes Dc1, Dc2, . . . , Dc4 and the resistors Rp serve as elements for causing a potential drop as will be described below.

The cathode electrodes of the first transfer thyristors T1, T3, . . . , T7 are connected to a first clock signal line 72. The cathode electrodes of the second transfer thyristors T2, T4, . . . , T8 are connected to a second clock signal line 73.

In other words, the first transfer thyristors T1, T3, . . . , T7 are different from the second transfer thyristors T2, T4, . . . , T8 in that the cathode electrode of each first transfer thyristor is connected to the first clock signal line 72 while the cathode electrode of each second transfer thyristor is connected to the second clock signal line 73.

The cathode terminals of the light-emitting thyristors L1, L2, . . . , L4 are connected to a lighting signal line 74.

To the gate electrode G1 of the first transfer thyristor T1, one of the terminals of a start diode Ds is connected, while the other terminal of the start diode Ds is connected to the second clock signal line 73. The start diode Ds is connected with its orientation set to allow a current to flow from the second clock signal line 73 to the gate electrode G1.

The anode terminals of the light-emitting thyristors L1, L2, . . . , L4, and the anode electrodes of the first transfer thyristors T1, T3, . . . , T7 and the second transfer thyristors T2, T4, . . . , T8 are connected to the backside common electrode 81 of the substrate 105, and thus supplied with the reference voltage Vsub (assumed here to be 0 V).

The gate electrodes G1, G2, . . . , G8 of the first transfer thyristors T1, T3, . . . , T7 and the second transfer thyristors T2, T4, . . . , T8 are connected to a power supply line 71 via load resistors R, respectively, and thus supplied with the power supply voltage Vga (assumed here to be −3.3 V).

The lighting signal line 74, the first clock signal line 72 and the second clock signal line 73 are connected to the lighting-signal terminal 101*a*, the first clock-signal terminal 101*b* and the second clock-signal terminal 101*c* through load resistors, respectively. The power supply line 71 is connected to the power supply terminal 101*d*.

Figure 6:
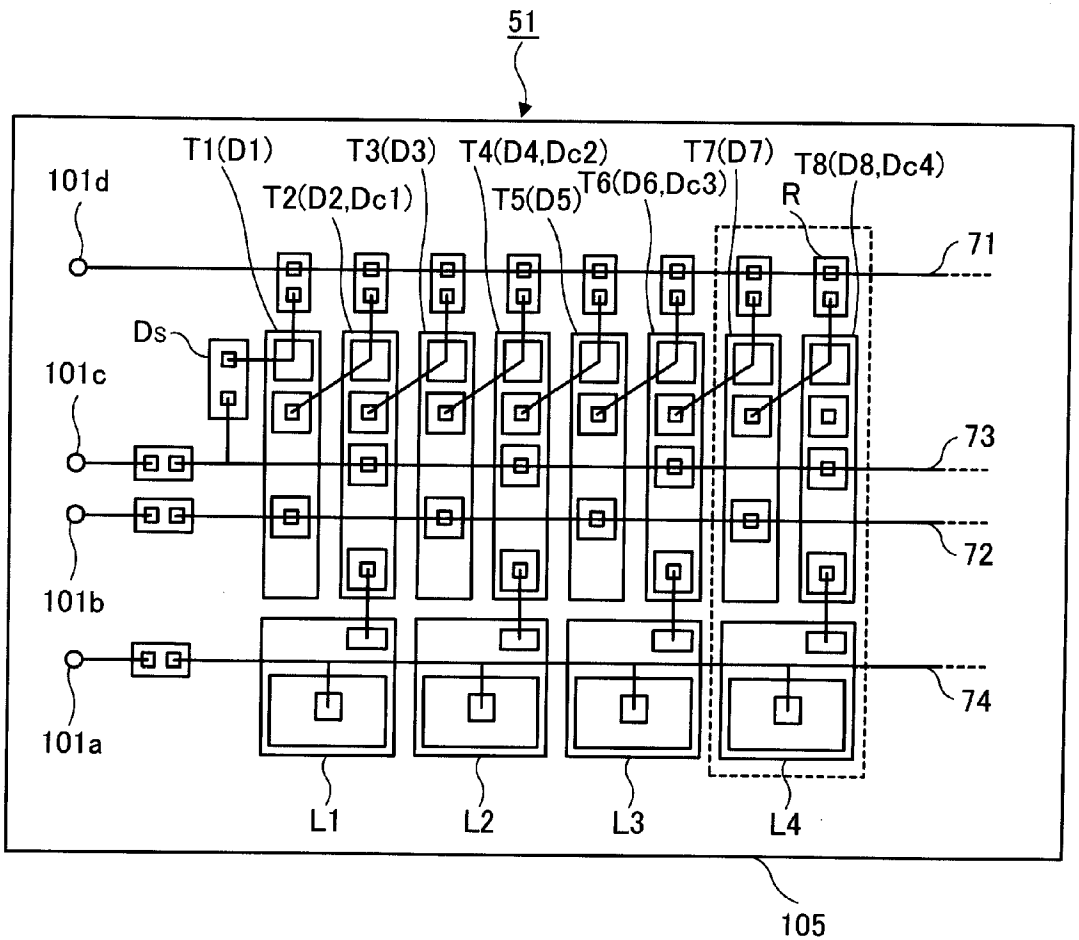
FIG. 6 is a plan view of each light-emitting element chip using the self-scanning light-emitting element array in the exemplary embodiment.

FIG. 6 is a plan view of each light-emitting element chip 51 using the self-scanning light-emitting element array in the exemplary embodiment. The leading portion shown in FIG. 6 of the light-emitting element chip 51 includes the substrate 105, the light-emitting thyristors L1, L2, . . . , L4, the first transfer thyristors T1, T3, . . . , T7, and the second transfer thyristors T2, T4, . . . , T8. In accordance with FIG. 5, FIG. 6 shows the leading portion including the four light-emitting thyristors L1, L2, . . . , L4, the four first transfer thyristors T1, T3, . . . , T7, and the four second transfer thyristors T2, T4, . . . , T8.

The light-emitting thyristor L1 is formed as an independent island. The first transfer thyristor T1 is formed as an island including the connecting diode D1, and thus the island is denoted by T1 (D1). The second transfer thyristor T2 is formed as an island including the connecting diode D2 and the coupling diode Dc1, and thus the island is denoted by T2 (D2, Dc1). The other light-emitting thyristors, the first and second transfer thyristors, and the like are formed in the same manner.

The lighting signal line 74, the first clock signal line 72 and the second clock signal line 73 are connected to the lighting-signal terminal 101*a*, the first clock-signal terminal 101*b* and the second clock-signal terminal 101*c* through the load resistors, respectively. The power supply line 71 is connected to the power supply terminal 101*d*.

Figure 7B:
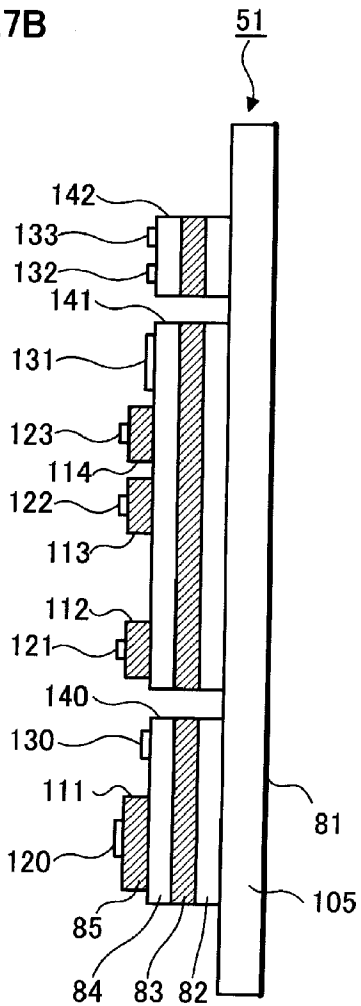
FIG. 7B is a cross-sectional view taken along the VIIB-VIIB line of FIG. 7A.
Figure 7A:
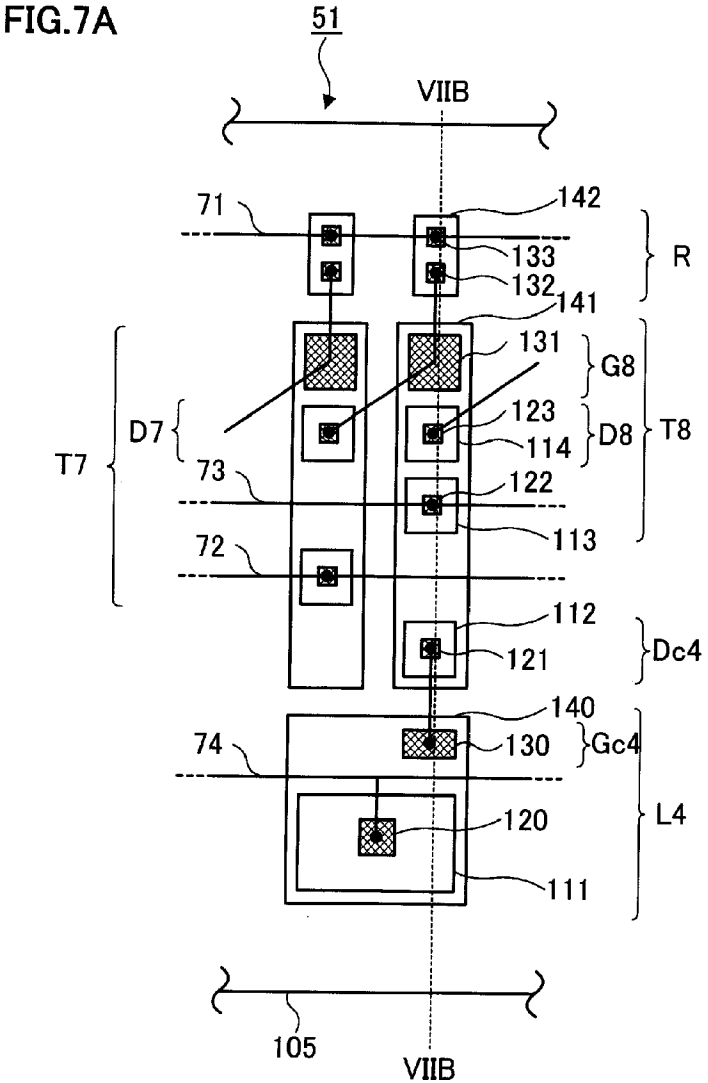
FIG. 7A is an enlarged plan view of the light-emitting element chip shown in FIG. 6.

FIG. 7A is an enlarged plan view of a portion including the light-emitting thyristor L4, enclosed by the dashed line, of the light-emitting element chip 51 shown in FIG. 6. FIG. 7B is a cross-sectional view taken along the VIIB-VIIB line of FIG. 7A. In the cross-sectional view of FIG. 7B, the power supply line 71 and the signal lines such as the first clock signal line 72 are not shown.

As shown in FIG. 7B, the light-emitting element chip 51 forms a pnpn structure in which a p-type first semiconductor layer 82, an n-type second semiconductor layer 83, a p-type third semiconductor layer 84 and an n-type fourth semiconductor layer 85 are sequentially stacked on the substrate 105. On the back surface of the substrate 105, the backside common electrode 81 is formed.

In a first island 140, the light-emitting thyristor L4 is formed in which the backside common electrode 81, an ohmic electrode 120 and an ohmic electrode 130 are used as the anode terminal, the cathode terminal and the gate terminal (Gc4), respectively. Here, the ohmic electrode 120 is formed on a region 111 of the n-type fourth semiconductor layer 85, while the ohmic electrode 130 is formed on the p-type third semiconductor layer 84 after etch removal of the n-type fourth semiconductor layer 85.

In a second island 141, the second transfer thyristor T8 is formed in which the backside common electrode 81, an ohmic electrode 122 and an ohmic electrode 131 are used as the anode terminal, the cathode terminal and the gate terminal (G8), respectively. Here, the ohmic electrode 122 is formed on a region 113 of the n-type fourth semiconductor layer 85, while the ohmic electrode 131 is formed on the p-type third semiconductor layer 84 after etch removal of the n-type fourth semiconductor layer 85. Additionally, in the second island 141, the connecting diode D8 is formed between an ohmic electrode 123 and the ohmic electrode 131, and the coupling diode Dc4 is formed between an ohmic electrode 121 and the ohmic electrode 131. Here, the ohmic electrodes 121 and 123 are formed on regions 112 and 114 of the n-type fourth semiconductor layer 85, respectively. The connecting diode D8 and the coupling diode Dc4 use a pn junction formed between the p-type third semiconductor layer 84 and the n-type fourth semiconductor layer 85.

In a third island 142, the load resistor R is formed between ohmic electrodes 132 and 133, which are formed on the p-type third semiconductor layer 84 after etch removal of the n-type fourth semiconductor layer 85. The load resistor R uses the p-type third semiconductor layer 84.

Note that the resistor Rp is not shown in FIGS. 7A and 7B since the resistor Rp uses a parasitic resistance attributable to the semiconductor layers and wiring.

As shown in FIG. 7A, the ohmic electrode 132 of the load resistor R is connected to the ohmic electrode 131, which serves as the gate electrode (G8) of the second transfer thyristor T8, and this ohmic electrode 131 is connected to the connecting diode D7. The ohmic electrode 123 of the connecting diode D8 is connected to the gate electrode of the first transfer thyristor T9 (not shown in the figure), which is adjacent to the connecting diode D8. The ohmic electrode 121 of the coupling diode Dc4 is connected to the ohmic electrode 130, which serves as the gate terminal (Gc4) of the light-emitting thyristor L4.

The ohmic electrode 133 of the third island 142, the ohmic electrode 122 of the second island 141, and the ohmic electrode 120 of the first island 140 are connected to the power supply line 71, the second clock signal line 73 and the lighting signal line 74, respectively.

The same holds true for the first transfer thyristor T7 and the connecting diode D7, and thus the description thereof is omitted.

Note that the substrate 105 may be made of a p-type semiconductor, and if the substrate 105 also functions as the p-type first semiconductor layer 82, the p-type first semiconductor layer 82 may not necessarily be formed.

In addition, though the first to third islands 140 to 142 are formed as separate islands in FIG. 7A, the first to third islands 140 to 142 may share some layers. Moreover, the second transfer thyristor T8, the connecting diode D8, the coupling diode Dc4 and the like may be separately formed.

Figures 8A, 8B:
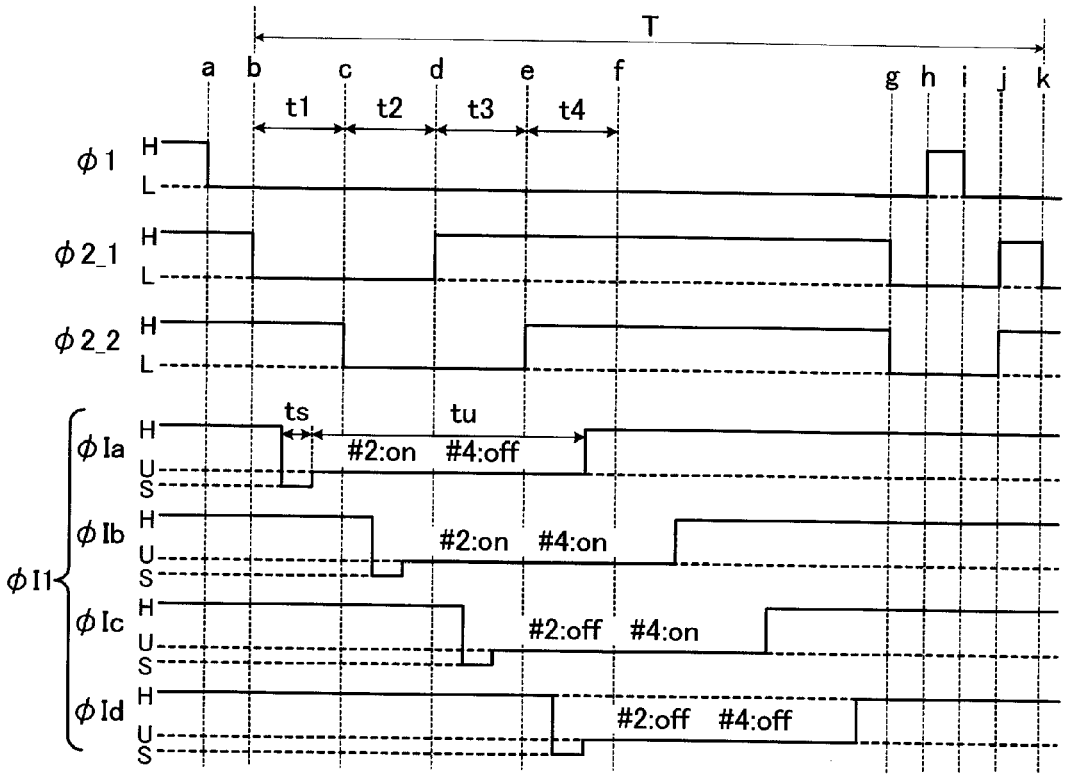
FIG. 8A is a time chart for explaining drive of the light-emitting element chips which belong to the group in the light-emitting element head.
FIG. 8B is a table for explaining combinations of the H level and the L level for the second clock signals.

FIG. 8A is a time chart for explaining drive of the light-emitting element chips 51 (#2 and #4), which belong to the B group in the light-emitting element head 100. The light-emitting element chips 51 have the same structure, as described above.

As has been described with reference to FIG. 4, the first clock-signal terminals 101*b* of #2 and #4 of the light-emitting element chips 51, which belong to the B group, are supplied with the first clock signal ϕ1, which is used in common among all the light-emitting element chips 51. The second clock-signal terminals 101*c* of #2 and #4 of the light-emitting element chips 51 are supplied with the 2_1-th and 2_2-th clock signals ϕ2_1 and ϕ2_2, which are different from each other. The lighting-signal terminals 101*a* of #2 and #4 of the light-emitting element chips 51 are supplied with the single first lighting signal ϕI1.

Firstly, with reference to FIGS. 5 and 8A, a description will be given of an operation of #2 of the light-emitting element chips 51, which belongs to the B group, that is, an operation of one of the light-emitting element chips 51 alone.

To begin with, a description will be given of how a transfer operation of the transfer element array 103 starts.

In the initial state, all of the first transfer thyristors T1, T3, . . . , T7, the second transfer thyristors T2, T4, . . . , T8, and the light-emitting thyristors L1, L2, L4 are turned off. In addition, the first clock signal ϕ1 and the 2_1-th clock signal ϕ2_1 are set to an H level, that is, to the reference voltage Vsub=0 V, for example. At this time, the potential of each of the gate electrodes G1, G2, G8 is set to the power supply voltage Vga=−3.3 V (L level).

In this initial state, the start diode Ds is forward biased, and thus the potential of the gate electrode G1 of the first transfer thyristor T1 changes from the L level to a value obtained by subtracting a forward threshold voltage (diffusion potential) Vd of the pn junction of the start diode Ds from the H level of the 2_1-th clock signal ϕ2_1. At this time, the potential of the gate electrode G1 of the first transfer thyristor T1 becomes −1.4 V since the forward threshold voltage Vd of the pn junction may be considered to be 1.4 V on the basis of the properties of the light-emitting element chip 51.

In general, an ON voltage Von for turning on any one of the first transfer thyristors, the second transfer thyristors and the light-emitting thyristors is expressed by Von<Vg−Vd, where Vg denotes the potential of the gate electrode of the thyristor. Since Vd denotes the forward threshold voltage (diffusion potential) of the pn junction, the ON voltage Von of the first transfer thyristor T1 is −2Vd=−2.8 V.

At a time point a in FIG. 8A, the potential of the first clock signal ϕ1 is set lower than −2.8 V, or set to the power supply voltage Vga=−3.3 V (L level), for example. In response, the first transfer thyristor T1 is turned on, and thereby the transfer operation of the transfer element array 103 starts.

Note that it is only in the initial state that the both the first and second clock signals ϕ1 and ϕ2 are at the H level.

When the first transfer thyristor T1 is turned on, the potential of the gate electrode G1 rises to the H level of 0 V. The effect of this electronic potential rise is transmitted to the gate electrode G2 through the connecting diode D1 that gets forward biased. Thereby, the potential of the gate electrode G2 is set to −Vd=−1.4 V, and thus the ON voltage Von of the second transfer thyristor T2 becomes −2.8 V.

At a time point b, the 2_1-th clock signal ϕ2_1 is set to the L level, which is lower than −2.8 V. In response, the second transfer thyristor T2 is turned on, and thereby the potential of the gate electrode G2 rises to the H level of 0 V. The effect of the electronic potential rise of the gate electrode G2 is transmitted to the gate electrode G3 through the connecting diode D2 that gets forward biased. Thereby, the potential of the gate electrode G3 is set to −Vd=−1.4 V, and thus the ON voltage Von of the first transfer thyristor T3 becomes −2.8 V.

At a time point d, the 2_1-th clock signal ϕ2_1 is set to the H level. In response, the second transfer thyristor T2 is turned off, and thereby the potential of the gate electrode G2 drops to the L level of −3.3 V. This further sets the potential of the gate electrode G3 back to −3.3 V. As a result, the ON voltage Von of the first transfer thyristor T3 becomes −4.7 V.

Note that, at the time point d, the first clock signal ϕ1 remains set to the L level, so that the first transfer thyristor T1 is kept turned on.

To continue the transfer operation by sequentially turning on the first transfer thyristor T1, the second transfer thyristor T2, the first transfer thyristor T3, . . . , the second transfer thyristor T8, it is necessary to turn on the first transfer thyristor T3 after turning on the first transfer thyristor T1 and the second transfer thyristor T2.

However, actually, the second transfer thyristor T2 gets turned off at the time point d, as described above. Accordingly, in order to turn on the first transfer thyristor T3, the 2_1-th clock signal ϕ2_1 is set to the L level at a time point g to turn on the second transfer thyristor T2 again. Thereby, the ON voltage Von of the first transfer thyristor T3 becomes −2.8 V as described above. After that, at a time point h, the first clock signal ϕ1 is set to the H level, so that the first transfer thyristor T1 gets turned off. Thereafter, at a time point i, the first clock signal ϕ1 gets set back to the L level, so that the first transfer thyristor T3 gets turned on. Then, at a time point j, the 2_1-th clock signal ϕ2_1 is set to the H level, so that the second transfer thyristor T2 gets turned off. In this way, the transfer operation is taken over from the second transfer thyristor T2 to the first transfer thyristor T3.

By returning, to the time point b, from a time point k when the 2_1-th clock signal ϕ2_1 changes from the H level to the L level, in order to repeat a cycle T, the operation is taken over from the first transfer thyristor T1 and the second transfer thyristor T2 to the first transfer thyristor T3 and the second transfer thyristor T4, and further to the subsequent first and second transfer thyristors.

As described above, in the operation of the self-scanning light-emitting element array in the present exemplary embodiment, the second transfer thyristor T2 changes from being turned on to being turned off, and then further to being turned on while the first transfer thyristor T1 is kept turned on.

Hereinbelow, a description will be given of an operation of the light-emitting element array 102.

When the first transfer thyristor T1 gets turned on, the potential of the gate terminal Gc1 of the light-emitting thyristor L1, which is positioned closest to the first transfer thyristor T1, becomes −2Vd+δ, where δ denotes a voltage drop caused by the corresponding resistor Rp. Here, this voltage drop, and the forward threshold voltages respectively of the connecting diode D1 and the coupling diode Dc1 cause the above potential change. Since it may be assumed that δ is −0.8 V, due to the properties of the light-emitting element chip 51, the potential of the gate terminal Gc1 of the light-emitting thyristor L1 is −3.6 V. Accordingly, the ON voltage Von of the light-emitting thyristor L1 becomes −3Vd+δ=−5 V. At this time, the ON voltage Von of each of the subsequent light-emitting thyristors L2, L3, . . . , becomes lower than −5 V.

Then, when the second transfer thyristor T2 gets turned on while the first transfer thyristor T1 is turned on, the ON voltage Von of the light-emitting thyristor L1 rises to −2Vd+δ=−3.6 V. Meanwhile, the ON voltage Von of the light-emitting thyristor L2 becomes −4Vd+δ=−6.4 V. Here, the light-emitting thyristor L2 is a light-emitting thyristor positioned second closest to the first transfer thyristor T1 after the light-emitting thyristor L1.

At this time, the first lighting signal ϕI1 is changed from the H level (0 V) to the state of having a voltage between −3.6 V and −5 V. When only the first transfer thyristor T1 is turned on, none of the light-emitting thyristors including the light-emitting thyristor L1 emits light. By contrast, when the second transfer thyristor T2 is turned on while the first transfer thyristor T1 is turned on, only the light-emitting thyristor L1 emits light.

Hereinbelow, a voltage causing only the light-emitting thyristor L1 to emit light may be referred to as light-emission voltage S, and the level corresponding thereto may be referred to as S level.

Note that, when the first transfer thyristor T3 gets turned on, the potential of the gate electrode G3 rises to the H level of 0 V. However, since the connecting diode D2 is reverse biased in this case, the effect of this electronic potential rise is not transmitted to the gate electrode G2. Accordingly, the potential of the gate electrode G2 remains −3.3 V, and thus the ON voltage Von of the light-emitting thyristor L1 becomes −6.9 V. As a result, the light-emission voltage S does not cause the light-emitting thyristor L1 to emit light.

As described above, if any of the first transfer thyristors T1, T3, . . . , T7 is turned on by changing the first clock signal ϕ1 from the H level to the L level, and if the adjacent one of the second transfer thyristors T2, T4, . . . , T8 is then turned on by changing the 2_1-th clock signal ϕ2_1 from the H level to the L level, the corresponding one of the light-emitting thyristors L1, L2, . . . , L4 is set ready to emit light.

In other words, the first clock signal ϕ1 serves as a transfer signal for causing the light-emitting thyristors L1, L2, . . . , L4 to sequentially emit light, while each second clock signal ϕ2 serves as a signal for setting the light-emitting thyristors L1, L2, . . . , L4 ready to emit light.

As described above, causing the light-emitting thyristors L1, L2, . . . , L4 in the present exemplary embodiment to emit light requires the light-emission voltage S having a negative value whose absolute value is higher than that of −3.6 V. However, once gets caused to emit light, each of the light-emitting thyristors L1, L2, . . . , L4 is allowed to be kept emitting light with a voltage (maintaining voltage) U having a negative value whose absolute value is lower than that of the light-emission voltage S. The maintaining voltage U may be set to the power supply voltage Vga=−3.3 V, for example.

Note that, any of the light-emitting thyristors L1, L2, . . . , L4 that emits no light is not caused to start emitting light only with the maintaining voltage U.

Next, a description will be given of an operation of #4 of the light-emitting element chips 51, which belongs to the B group. As is clear from FIG. 8A, #2 and #4 of the light-emitting element chips 51, which belong to the B group, are different from each other in that #2 and #4 of the light-emitting element chips 51 are supplied with the 2_1-th clock signal ϕ2_1 and the 2_2-th clock signal ϕ2_2, respectively. However, since #2 and #4 of the light-emitting element chips 51 have the same structure, as described above, the operation of #4 of the light-emitting element chips 51 is the same as the foregoing operation of #2 of the light-emitting element chips 51. Accordingly, in #4 of the light-emitting element chips 51 as well, if any of the first transfer thyristors T1, T3, . . . , T7 is turned on by changing the first clock signal ϕ1 from the H level to the L level, and if the adjacent one of the second transfer thyristors T2, T4, . . . , T8 is then turned on by changing the 2_2-th clock signal ϕ2_2 from the H level to the L level, the corresponding one of the light-emitting thyristors L1, L2, . . . , L4 is set ready to emit light.

Hereinafter, a description will be given of an operation of driving the light-emitting element chips 51 in groups, by taking the B group as an example. To begin with, a difference between the 2_1-th clock signal ϕ2_1 and the 2_2-th clock signal ϕ2_2 will be described.

FIG. 8B is a table for explaining combinations of the H level and the L level for the 2_1-th and 2_2-th clock signals ϕ2_1 and ϕ2_2. For the 2_1-th and 2_2-th clock signals ϕ2_1 and ϕ2_2, there are four possible combinations of the H and L levels. The four combinations are assigned to periods t1 to t4, respectively. Specifically,

- the period t1 (period from the time point b to the time point c shown in FIG. 8A): ϕ2_1 is L, and ϕ2_2 is H;
- the period t2 (period from the time point c to the time point d shown in FIG. 8A): ϕ2_1 is L, and ϕ2_2 is L;
- the period t3 (period from the time point d to the time point e shown in FIG. 8A): ϕ2_1 is H, and ϕ2_2 is L; and
- the period t4 (period from the time point e to the time point f shown in FIG. 8A): ϕ2_1 is H, and ϕ2_2 is H.

In other words, the period T per cycle for the first clock signal ϕ1 further includes multiple periods for the second clock signals ϕ2. Specifically, the multiple periods, such as the periods t1 to t4, are provided for setting the respective light-emitting thyristors L1, L2, . . . , L4 ready to emit light.

As a result, in the periods t1 to t4, the 2__1-th clock signal ϕ2_1 changes in a pattern of "LLHH," while the 2__2-th clock signal ϕ2_2 changes in a pattern of "HLLH," as shown in FIG. 8A. After the period t4, both the signals are set to the H level. In other words, the 2__1-th clock signal ϕ2_1 is different from the 2__2-th clock signal ϕ2_2 in regard to the H level periods and the L level periods.

As described above, if any of the first transfer thyristors T1, T3, . . . , T7 is turned on by changing the first clock signal (pi from the H level to the L level, and if the adjacent one of the second transfer thyristors T2, T4, . . . , T8 is then turned on by setting the 2__1-th clock signal ϕ2_1 or the 2__2-th clock signal ϕ2_2 to the L level, the corresponding one of the light-emitting thyristors L1, L2, . . . , L4 is set ready to emit light. If the first lighting signal ϕI1 is changed from the H level to the S level while any of the light-emitting thyristors L1, L2, . . . , L4 is ready to emit light, the light-emitting thyristor emits light.

Here, as shown in FIG. 8A, it is assumed that the first lighting signal ϕI1 has a signal waveform including a light-emission voltage period ts and a maintaining voltage period tu. Here, the light-emission voltage S is supplied in the light-emission voltage period ts, while the maintaining voltage U for maintaining a light-emitting state is supplied in the maintaining voltage period tu. Note that, the maintaining voltage U maintains the light-emitting state of any of the light-emitting thyristors L1, L2, . . . , L4 that is emitting light, but the maintaining voltage U does not cause any of the light-emitting thyristors L1, L2, . . . , L4 to start emitting light, if the light-emitting thyristor emits no light.

In the present exemplary embodiment, set are the following four lighting signal waveforms in which the light-emission voltage periods ts are included in the periods t1 to t4, respectively:

- a first lighting signal waveform ϕIa: the light-emission voltage period ts is included in the period t1;
- a second lighting signal waveform ϕIb: the light-emission voltage period ts is included in the period t2;
- a third lighting signal waveform ϕIc: the light-emission voltage period ts is included in the period t3; and
- a fourth lighting signal waveform ϕId: the light-emission voltage period ts is included in the period t4.

Here, the light-emission voltage period ts needs to be included within any of the periods t1 to t4, and must not extend across any boundary between the periods t1 to t4. Note that the maintaining voltage period tu, which will be described later, may extend across any boundary between the periods t1 to t4.

Hereinafter, a description will be given of the case of using the lighting signal waveforms to cause the light-emitting thyristors L1 respectively of #2 and #4 of the light-emitting element chips 51 to emit light.

In the periods t1 to t4, the first clock signal ϕ1 supplied to #2 and #4 of the light-emitting element chips 51 is set to the L level, and thus the first transfer thyristors T1 are kept turned on.

To begin with, a description will be given of the case of using the first lighting signal waveform ϕIa as the first lighting signal ϕI1.

In the period t1 for supplying the 2__1-th clock signal ϕ2_1, the 2__1-th clock signal ϕ2_1 set to the L level is supplied to #2 of the light-emitting element chips 51. This turns on the second transfer thyristor T2 therein, and thus sets the corresponding light-emitting thyristor L1 ready to emit light. In this period t1, the first lighting signal waveform ϕIa drops to the light-emission voltage S, and thus the light-emitting thyristor L1 of #2 of the light-emitting element chips 51 emits light.

At the time point d, the 2__1-th clock signal ϕ2_1 becomes the H level, so that the second transfer thyristor T2 gets turned off. Nevertheless, the light-emitting thyristor L1 is kept emitting light by the maintaining voltage U during the maintaining voltage period tu of the first lighting signal waveform ϕIa.

Meanwhile, in the period t1, the 2__2-th clock signal ϕ2_2 set to the H level is supplied to #4 of the light-emitting element chips 51, so that the second transfer thyristor T2 therein remains turned off. Accordingly, in the period t1, even though the first lighting signal waveform ϕIa drops to the light-emission voltage S, the corresponding light-emitting thyristor L1 continues to emit no light.

At a time point c, the 2__2-th clock signal ϕ2_2 becomes the L level, so that the second transfer thyristor T2 gets turned on. However, in the periods t2 and t3 during which the second transfer thyristor T2 is kept turned on, the first lighting signal waveform ϕIa is set to the maintaining voltage U, so that the light-emitting thyristor L1 is not allowed to emit light, and thus continues to emit no light.

Next, a description will be given of the case of using the second lighting signal waveform ϕIb as the first lighting signal ϕI1.

In the period t1, the 2__1-th clock signal ϕ2_1 set to the L level is supplied to #2 of the light-emitting element chips 51. This turns on the second transfer thyristor T2 therein, and thus sets the corresponding light-emitting thyristor L1 ready to emit light. However, during the period t1, the second lighting signal waveform ϕIb is at the H level, and thus the light-emitting thyristor L1 emits no light.

In the period t2, the 2__1-th clock signal ϕ2_1 remains at the L level. Accordingly, the second transfer thyristor T2 is kept turned on, and thus the corresponding light-emitting thyristor L1 remains ready to emit light. In this period t2, the second lighting signal waveform ϕIb drops to the S level, and thus the light-emitting thyristor L1 emits light.

At the time point d, the 2__1-th clock signal Tϕ2_1 becomes the H level, so that the second transfer thyristor T2 gets turned off. Nevertheless, the light-emitting thyristor L1 is kept emitting light by the maintaining voltage U during the maintaining voltage period tu of the second lighting signal waveform ϕIb.

Meanwhile, in the period t1, the 2__2-th clock signal ϕ2_2 set to the H level is supplied to #4 of the light-emitting element chips 51, so that the second transfer thyristor T2 therein remains turned off. Accordingly, in the period t1, the corresponding light-emitting thyristor L1 continues to emit no light.

At the time point c, the 2__2-th clock signal ϕ2_2 becomes the L level, so that the second transfer thyristor T2 gets turned on. In response, the corresponding light-emitting thyristor L1 is set ready to emit light. Accordingly, in the period t2, the second lighting signal waveform ϕIb drops to the S level, and thus the light-emitting thyristor L1 emits light.

At the time point e, the 2__2-th clock signal Tϕ2_2 becomes the H level, so that the second transfer thyristor T2 gets turned off. Nevertheless, the light-emitting thyristor L1 is kept emitting light by the maintaining voltage U during the maintaining voltage period tu of the second lighting signal waveform ϕIb.

Next, a description will be given of the case of using the third lighting signal waveform ϕIc as the first lighting signal ϕI1.

In the periods t1 and t2, the 2__1-th clock signal ϕ2_1 set to the L level is supplied to #2 of the light-emitting element chips 51. This turns on the second transfer thyristor T2 therein, and thus sets the corresponding light-emitting thyristor L1 ready to emit light. However, during the periods t1 and t2, the third lighting signal waveform ϕIc is at the H level, and thus the light-emitting thyristor L1 emits no light.

At the time point d, the 2__1-th clock signal ϕ2_1 becomes the H level, so that the second transfer thyristor T2 gets turned off. Accordingly, the light-emitting thyristor L1 is not ready to emit light. Thus, in the period t3, even though the third lighting signal waveform ϕIc drops to the S level, the light-emitting thyristor L1 continues to emit no light. In addition, during the period t4, the second transfer thyristor T2 is kept turned off, and thus the light-emitting thyristor L1 is not set ready to emit light.

Meanwhile, in the period t1, the 2__2-th clock signal ϕ2_2 set to the H level is supplied to #4 of the light-emitting element chips 51, so that the second transfer thyristor T2 therein remains turned off. Accordingly, the corresponding light-emitting thyristor L1 is not set ready to emit light, and thus continues to emit no light.

At the time point c, the 2__2-th clock signal ϕ2_2 becomes the L level, so that the second transfer thyristor T2 gets turned on. Accordingly, the light-emitting thyristor L1 is set ready to emit light in the periods t2 and t3. In the period t2, the third lighting signal waveform ϕIc is at the H level, so that the light-emitting thyristor L1 emits no light. However, in the period t3, the third lighting signal waveform ϕIc drops to the S level, and thus the light-emitting thyristor L1 emits light.

At the time point e, the 2__2-th clock signal ϕ2_2 becomes the H level, so that the second transfer thyristor T2 gets turned off. Nevertheless, the light-emitting thyristor L1 is kept emitting light by the maintaining voltage U during the maintaining voltage period tu of the third lighting signal waveform ϕIc.

Lastly, a description will be given of the case of using the fourth lighting signal waveform ϕId as the first lighting signal ϕI1.

In the periods t1 and t2, the 2__1-th clock signal ϕ2_1 set to the L level is supplied to #2 of the light-emitting element chips 51. This turns on the second transfer thyristor T2 therein, and thus sets the corresponding light-emitting thyristor L1 ready to emit light. However, during the periods t1 and t2, the fourth lighting signal waveform ϕId is at the H level, and thus the light-emitting thyristor L1 emits no light.

At the time point d, the 2__1-th clock signal ϕ2_1 becomes the H level. Accordingly, in the periods t3 and t4, the second transfer thyristor T2 is turned off, and thus the light-emitting thyristor L1 is not set ready to emit light, and thus continues to emit no light.

Meanwhile, in the period t1, the 2__2-th clock signal ϕ2_2 set to the H level is supplied to #4 of the light-emitting element chips 51, so that the second transfer thyristor T2 therein remains turned off. Accordingly, the corresponding light-emitting thyristor L1 is not set ready to emit light, and thus continues to emit no light.

At the time point c, the 2__2-th clock signal ϕ2_2 becomes the L level, so that the second transfer thyristor T2 gets turned on. Accordingly, the light-emitting thyristor L1 is set ready to emit light in the periods t2 and t3. However, in the periods t2 and t3, the fourth lighting signal waveform ϕId is at the H level, so that the light-emitting thyristor L1 continues to emit no light.

At the time point e, the 2__2-th clock signal ϕ2_2 becomes the H level, so that the second transfer thyristor T2 gets turned off. Accordingly, the light-emitting thyristor L1 is not set ready to emit light. Hence, even though the fourth lighting signal waveform ϕId drops to the S level, the light-emitting thyristor L1 continues to emit no light.

From the above description, a summary is given in which the combination of the emitting light and no light of the light-emitting thyristors L1 respectively of #2 and #4 of the light-emitting element chips 51 varies depending on the lighting signal waveform, as described below.

The first lighting signal waveform ϕIa: L1 of #2 emits light, but L1 of #4 emits no light;

the second lighting signal waveform ϕIb: L1 of #2 and L1 of #4 both emit light;

the third lighting signal waveform ϕIc: L1 of #2 emits no light, but L1 of #4 emits light; and the fourth lighting signal waveform ϕId: L1 of #2 and L1 of #4 both emit no light.

As described above, by using the first to fourth lighting signal waveforms ϕIa to ϕId, whose timing of supplying the light-emission voltage period ts vary from the period t1 to the period t4, a control may be made on the basis of any combination of the light emission and non-light emission of the light-emitting thyristors L1 respectively of the multiple light-emitting element chips 51 belonging to one of the groups. Moreover, repeating this operation allows the sequential control of the light-emitting thyristors L2, L3, . . . , of each of the light-emitting element chips 51 belonging to one of the groups.

Note that, in the case of causing all the multiple light-emitting element chips 51 belonging to one of the groups to emit no light, which is equivalent to the foregoing case of employing the fourth lighting signal waveform ϕId, the fourth lighting signal waveform ϕId may not necessarily be used. Instead, the lighting signal waveform kept set to the H level, without being provided with the light-emission voltage period ts and the maintaining voltage period tu, may be used.

Note that the light-emitting period of the light-emitting thyristor L1 is defined as the total period of the light-emission voltage period ts and the maintaining voltage period tu, and thus may appropriately be set. However, the end time point of the maintaining voltage period tu may be set to a point prior to the time point k when the next light-emitting thyristor L2 starts operating.

Hereinbelow, an operation of the light-emitting element head 100 will be described.

Though the above description has been given of the B group, the same holds true for the other groups, that is, the A, C and D groups. As has been described with reference to FIG. 3, it is only necessary to use the different lighting signals ϕI (the second to fourth lighting signals ϕI2 to ϕI4) respectively for the different groups, while using the same second clock signals ϕ2 (the 2__1-th clock signal ϕ2_1 and the 2__2-th clock signal ϕ2_2) for each of the different groups.

Hereinabove, the description has been given of the light-emitting element head 100 in which the light-emitting element chips 51 are divided into groups each formed of two light-emitting element chips 51.

Figures 9A, 9B:
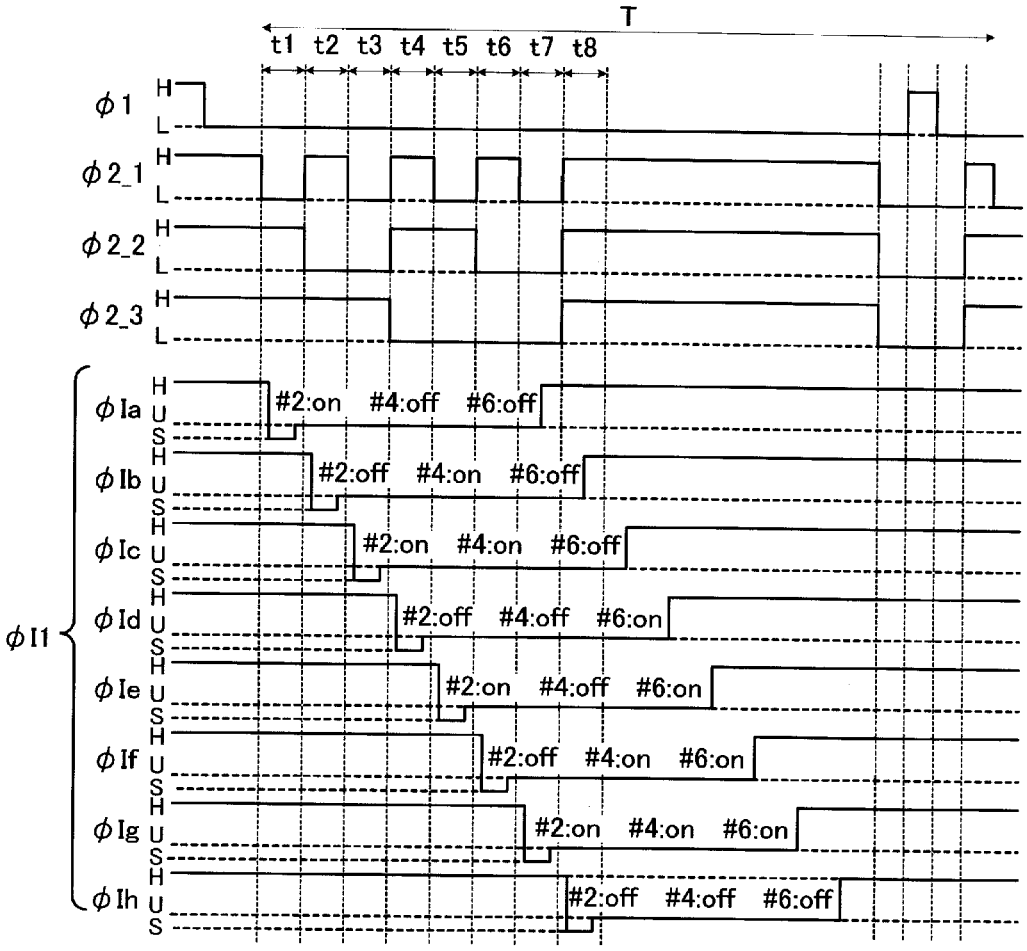
FIGS. 9A and 9B illustrate a method of driving the light-emitting element head in which the light-emitting element chips are divided into groups each formed of three light-emitting element chips.

FIGS. 9A and 9B illustrate a method of driving the light-emitting element head 100 in which the light-emitting element chips 51 are divided into groups each formed of three light-emitting element chips 51, such as a group of #2, #4 and #6 of FIG. 3B, for example.

As shown in FIG. 9A, three second clock signals ϕ2 different from one another, that is, the 2__1-th clock signal ϕ2_1, the 2__2-th clock signal ϕ2_2 and a 2__3-th clock signal ϕ2_3, are used for the respective light-emitting element chips 51 belonging to one of the groups, while the first lighting signal ϕI1 is used in common.

As shown in FIG. 9B, the 2_1-th clock signal ϕ2_1, the 2_2-th clock signal ϕ2_2 and the 2_3-th clock signal ϕ2_3 respectively have waveforms obtained by assigning eight possible time-based combinations of the H and L levels for these signals respectively to eight periods (the periods t1 to t8). In addition, as shown in FIG. 9A, one lighting signal waveform is selected from eight lighting signal waveforms ϕIa to ϕIh respectively having different timing of supplying the light-emission voltage period ts corresponding to the respective periods t1 to t8, and then used as the first lighting signal ϕI1. Thereby, a sequential control of the light-emitting thyristors L1, L2, L3, . . . , of each of the three light-emitting element chips 51 may be made on the basis of any combination of the light emission and non-light emission.

Note that, in the case of causing all the light-emitting element chips 51 belonging to one of the groups to emit no light, which is equivalent to the case of employing the lighting signal waveform ϕIh, the lighting signal waveform ϕIh may not necessarily be used. Instead, the lighting signal waveform kept set to the H level, without being provided with the light-emission voltage period ts and the maintaining voltage period tu, may be used.

As to the whole light-emitting element head 100, it is only necessary to use the different lighting signals ϕI (the second lighting signal ϕI2, the third lighting signal ϕI3, . . . ) respectively for the different groups, while using the same second clock signals ϕ2 (the 2_1-th clock signal ϕ2_1, the 2_2-th clock signal ϕ2_2 and the 2_3-th clock signal ϕ2_3) for each of the different groups.

Moreover, the light-emitting element chips 51 may be divided into groups each formed of four or more light-emitting element chips 51, and the any number of groups may be employed.

Figure 10B:
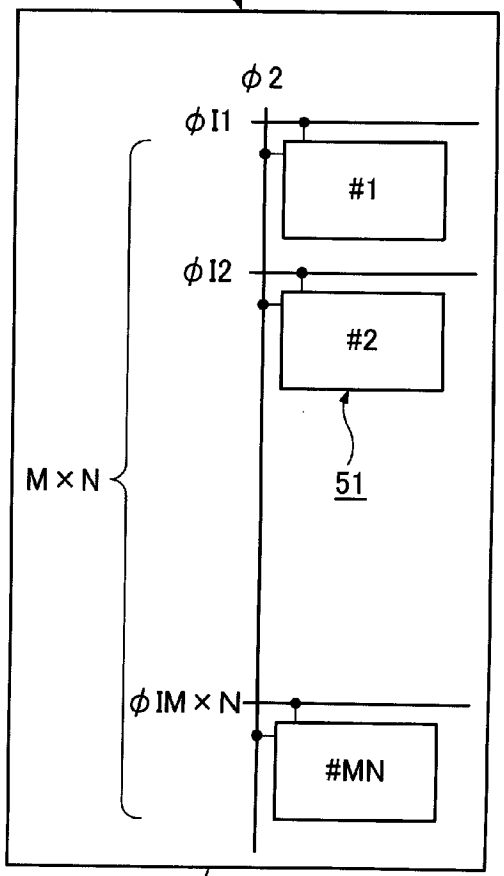
FIGS. 10A and 10B illustrate an effect of reducing the number of signal bus lines in the light-emitting element head.
Figure 10A:
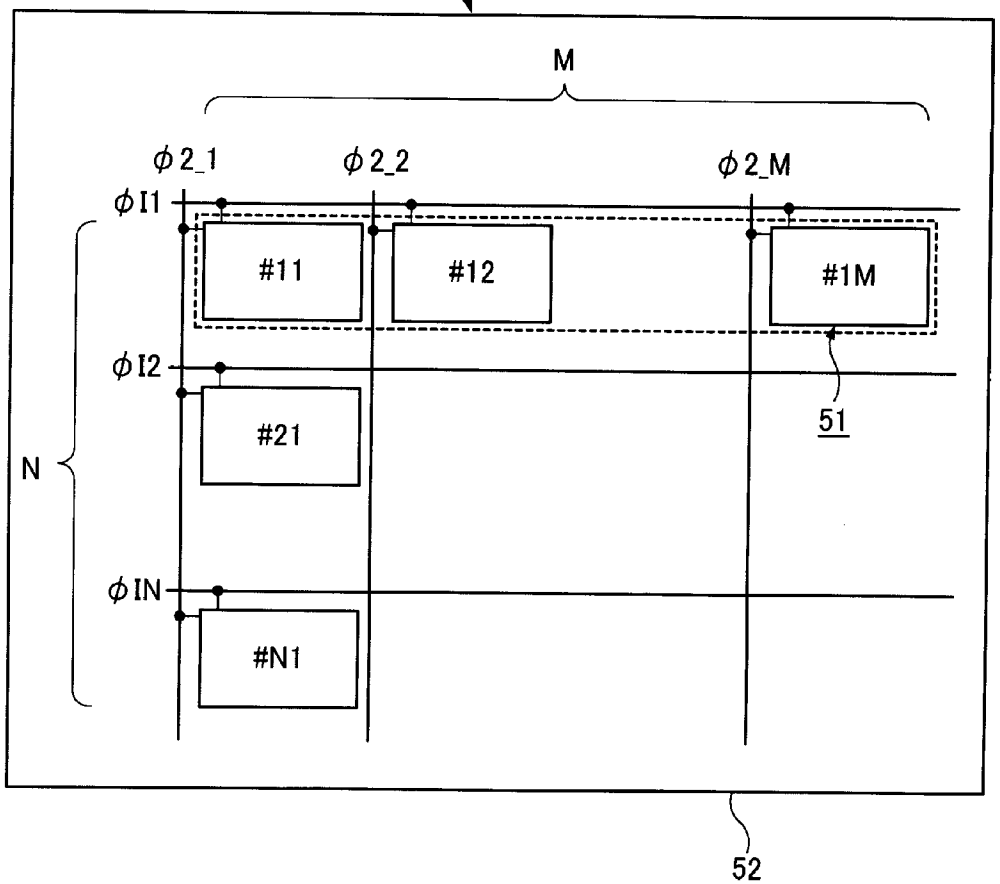

FIGS. 10A and 10B illustrate an effect of reducing the number of signal bus lines in the light-emitting element head 100. Here, a description will be given under the assumption that M×N light-emitting element chips 51 are arrayed, where M and N each are an integer of 2 or more. FIG. 10A shows the case of driving the light-emitting element chips 51 by dividing the light-emitting element chips 51 into N groups each formed of M light-emitting element chips 51. FIG. 10B shows the case of driving the M×N light-emitting element chips 51 on a single chip basis. Among the bus lines required to drive the light-emitting element chips 51, lines used in common for all the light-emitting element chips 51, that is, a first clock-signal bus line, a power supply bus line and a reference voltage bus line are not shown in FIGS. 10A and 10B.

Firstly, a description will be given of the case of driving the light-emitting element chips 51 forming the groups shown in FIG. 10A.

#11 to #1M of the light-emitting element chips 51 form a first group.

#11 to #1M of the light-emitting element chips 51 belonging to the first group are supplied with different second clock signals ϕ2, that is, the 2_1-th clock signal ϕ2_1 to a 2_M-th clock signal ϕ2_M, respectively. Specifically, these clock signals are each provided with $2^M$ periods to allow the light-emission voltage period ts to be supplied in different timings.

The first lighting signal ϕI1 is used in common in the first group.

In the light-emitting element head 100, N different lighting signals ϕI (the first to N-th lighting signals ϕI1 to ϕIN) are used respectively for the different groups, while the same M second clock signals ϕ2, that is, the 2_1-th to 2_M-th clock signal ϕ2_1 to ϕ2_M are used for each of the different groups. Accordingly, the required number of lighting signal bus lines and the required number of second clock-signal bus lines are N and M, respectively, and thus the total required number of signal bus lines including a first clock-signal bus line is M+N+1.

Secondly, a description will be given of the case of driving the light-emitting element chips 51 on a single chip basis, as shown in FIG. 10B.

A single second clock signal ϕ2 is used in common for all the light-emitting element chips 51. However, M×N different lighting signals ϕI, that is the first to M×N-th lighting signals ϕI1 to ϕIM×N, are used respectively for the light-emitting element chips 51. Accordingly, the required number of lighting signal bus lines is M×N, and thus the total required number of signal bus lines including first and second clock-signal bus lines is M×N+2.

Thus, the number of signal bus lines reduced by driving the M×N light-emitting element chips 51 in the groups is M×N−(M+N)+1.

In the case of the eight light emitting element chips 51 divided into groups each formed of two chips as shown in FIG. 3B, the number M of light-emitting element chips 51 belonging to each group is 2, and the number N of the different groups is 4, so that the number of signal bus lines is 7. Meanwhile, in the case of driving the eight light-emitting element chips 51 on a single chip basis, the number of signal bus lines is 10. Hence, the grouping leads to reduction of the signal bus lines by three.

In the case of 16 light-emitting element chips 51 divided into groups each formed of two chips, the number M of light-emitting element chips 51 belonging to each group is 2, and the number N of the different groups is 8, so that the number of signal bus lines is 11. Meanwhile, in the case of driving the 16 light-emitting element chips 51 on a single chip basis, the number of signal bus lines is 18. Hence, the grouping leads to reduction of the signal bus lines by seven.

In the case of 114 light-emitting element chips 51 divided into groups each formed of two chips, the number M of light-emitting element chips 51 belonging to each group is 2, and the number N of the different groups is 57, so that the number of signal bus lines is 60. Meanwhile, in the case of driving 114 light-emitting element chips 51 on a single chip basis, the number of signal bus lines is 116. Hence, the grouping leads to reduction of the signal bus lines by 56.

Thus, the larger the number of the light-emitting element chips 51 is, the larger effect the grouping gives at reducing the number of signal bus lines.

Similar calculation results may be obtained for any other combination of the number of the light-emitting element chips 51 belonging to each group and the number of the groups.

Note that FIGS. 10A and 10B are provided in order to illustrate the effect of reducing the number of signal bus lines, and thus the M×N light-emitting element chips 51 are not arrayed in a zigzag pattern therein. However, the M×N light-emitting element chips 51 may be arrayed in a zigzag pattern as in FIG. 3B, and the signal bus lines may be provided on the basis of the connection relation shown in FIG. 10A.

The number of light-emitting element chips 51 in each group is set to M herein. However, the number of light-emitting element chips 51 belonging to a group may vary among different groups. Alternatively, the number of light-emitting element chips 51 belonging to each group may be less than M.

As has been described with reference to FIG. 5, the light-emission voltage S for the light-emitting elements L1, L2, . . . , is a negative voltage whose absolute value is higher than that of −3.6 V in the self-scanning light-emitting element array of the present exemplary embodiment. In addition, it has been described that the power supply voltage Vga of −3.3 V may be used as the maintaining voltage U. Hence, a power supply for supplying the light-emission voltage S may not necessarily be provided. Instead, an overshoot circuit may be employed to generate the light-emission voltage S from the power supply voltage Vga. Note that, as the overshoot circuit, a circuit such as a so-called charge pump circuit using charges accumulated in a capacitor may be used.

In the present exemplary embodiment, the coupling diodes Dc1, Dc2, . . . , Dc4 are provided as elements for causing a potential drop. However, the coupling diodes may not necessarily be provided. In the case of not providing the coupling diodes Dc1, Dc2, . . . , Dc4, the ON voltage Von of the light-emitting thyristor L1 is −3.6 V under the condition where the first transfer thyristor T1 is turned on while the second transfer thyristor T2 is turned off. Meanwhile, under the condition where the first transfer thyristor T1 and the second transfer thyristor T2 are both turned on, the ON voltage Von of the light-emitting thyristor L1 is −2.2 V. Accordingly, the light-emitting element head 100 may be driven by using: the light-emission voltage S set to a voltage between −2.2 V and −3.6 V; and the maintaining voltage U set to a negative voltage whose absolute value is lower than that of the light-emission voltage S.

Moreover, in the present exemplary embodiment, the gate terminals Gc1, Gc2, . . . , Gc4 of the light-emitting thyristors L1, L2, . . . , L4 may be connected to a predetermined power supply via the load resistors R, respectively. With this configuration, light-emitting thyristors other than those set ready to emit light may be prevented from malfunctioning to emit light, by pulling down the potential of their gate electrodes to a power supply voltage.

In the exemplary embodiment of the present invention, a description has been given of the case where each of the first and second transfer thyristors is a three-terminal thyristor whose anode electrode is supplied with the reference voltage Vsub, and where each of the light-emitting thyristors is a three-terminal thyristor whose anode terminal is supplied with the reference voltage Vsub. However, if polarities of a circuit are changed, an alternative case may be employed. Specifically, each of the first and second transfer thyristors may be a three-terminal thyristor whose cathode electrode is supplied with the reference voltage Vsub, while each of the light-emitting thyristors may be a three-terminal thyristor whose cathode terminal is supplied with the reference voltage Vsub.

In the exemplary embodiment of the present invention, the light-emitting element chips 51 are formed of a GaAs-based semiconductor, but the material of the light-emitting element chips 51 is not limited to this. For example, the light-emitting element chips may be formed of another composite semiconductor such as GaP, which is difficult to turn into a p-type semiconductor or a n-type semiconductor by ion implantation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting element head, comprising:

a plurality of light-emitting element chips in each of which a plurality of transfer elements and a plurality of light-emitting elements are arrayed in a line, the plurality of light-emitting elements being provided corresponding to the plurality of transfer elements;

a lighting signal supply unit for supplying a plurality of lighting signals, each of the plurality of lighting signals corresponding to a respective one of N groups into which the plurality of light-emitting element chips are divided, and being provided to each of the light-emitting element chips that belong to the respective one of the N groups, where N is an integer of 2 or more; and a clock signal supply unit for supplying a first clock signal as a transfer signal for causing the plurality of light-emitting elements of each of the plurality of light-emitting element chips to sequentially emit light, the first clock signal being supplied to each of the plurality of light-emitting element chips in a common manner, and a plurality of second clock signals for setting the plurality of light-emitting elements ready to emit light, the plurality of second clock signals being supplied to respective light-emitting element chips belonging to a said group, and being supplied in a common manner across the N groups, wherein each of the plurality of second clock signals is provided with a plurality of periods falling within a period in which one of the plurality of transfer elements of each of the plurality of light-emitting element chips is kept turned on by the first clock signal, the number of the plurality of periods being determined according to the number of combinations of light emission and non-light emission of the plurality of light-emitting element chips included in each of the N groups, each of the combinations corresponding to a respective one of the plurality of periods, the clock signal supply unit supplies the plurality of second clock signals on the basis of the combinations, such that a transfer element adjacent to a turned-on transfer element in the direction of sequential lighting of the light-emitting elements is set to turn on, and the lighting signal supply unit starts supplying each of the plurality of lighting signals in a period that corresponds to a respective one of the combinations of the light emission and non-light emission of the light-emitting element chips in each of the N groups, among the plurality of periods provided for each of the plurality of second clock signals.

2. The light-emitting element head according to claim 1, wherein each of the plurality of second clock signals supplied by the clock signal supply unit is further provided with a period in which the adjacent transfer element is set to turn on, the period coinciding with the end time point of the period in which any one of the plurality of transfer elements of each of the plurality of light-emitting element chips is kept turned on by the first clock signal.

3. The light-emitting element head according to claim 1, wherein each of the plurality of light-emitting elements of each of the plurality of light-emitting element chips is provided for every other transfer element of the plurality of transfer elements.

4. The light-emitting element head according to claim 1, wherein the light-emitting element chips each include:

a plurality of first transfer thyristors each having an anode electrode, a cathode electrode and a gate electrode, the first clock signal being supplied to any one of the anode electrode and the cathode electrode;

a plurality of second transfer thyristors each having an anode electrode, a cathode electrode and a gate electrode, one of the second clock signals being supplied to any one of the anode electrode and the cathode electrode;

diodes each connected between the gate electrode of one of the first transfer thyristors and the gate electrode of one of the second transfer thyristors adjacent to the one of the first transfer thyristors so that the first transfer thyristors and the second transfer thyristors are alternately connected in an array direction; and light-emitting thyristors which are the said light-emitting elements each having an anode terminal, a cathode terminal and a gate terminal, the gate terminal being connected to the gate electrode of corresponding one of the second transfer thyristors, one of the lighting signals being supplied to any one of the anode terminal and the cathode terminal of the light-emitting thyristor.

5. The light-emitting element head according to claim 4, wherein the lighting signals each have:

a light-emission voltage period in which a voltage for causing one of the light-emitting thyristors to emit light is applied to the one of the light-emitting thyristors; and a maintaining voltage period, which is subsequent to the light-emission voltage period, and in which a voltage for keeping the one of the light-emitting thyristors emitting light is applied to the one of the light-emitting thyristors.

6. A light-emitting element chip, comprising:

a substrate;

a first clock signal line for supplying a first clock signal as a transfer signal for causing light-emitting elements to sequentially emit light, the first clock signal line being connected to a first clock signal terminal;

a second clock signal line for supplying a second clock signal for setting the light-emitting elements ready to emit light, the second clock signal line being connected to a second clock signal terminal;

a lighting signal line for supplying a lighting signal for setting whether or not the light-emitting elements emit light, the lighting signal line being connected to a lighting signal terminal;

a power supply line for supplying a power supply voltage, the power supply line being connected to a power supply terminal;

a backside common electrode supplied with a reference voltage;

a plurality of first transfer thyristors each having an anode electrode, a cathode electrode and a gate electrode, any one of the anode electrode and the cathode electrode being connected to the first clock signal line, the other one of the anode electrode and the cathode electrode being connected to the backside common electrode, the gate electrode being connected to the power supply line via a resistor;

a plurality of second transfer thyristors each having an anode electrode, a cathode electrode and a gate electrode, any one of the anode electrode and the cathode electrode being connected to the second clock signal line, the other one of the anode electrode and the cathode electrode being connected to the backside common electrode, the gate electrode being connected to the power supply line via a resistor;

diodes each connected between the gate electrode of one of the first transfer thyristors and the gate electrode of one of the second transfer thyristors adjacent to the one of the first transfer thyristors so that the first transfer thyristors and the second transfer thyristors are alternately connected in an array direction; and light-emitting thyristors each having an anode terminal, a cathode terminal and a gate terminal, the gate terminal being connected to the gate electrode of corresponding one of the second transfer thyristors, any one of the anode terminal and the cathode terminal being connected to the lighting signal line, the other one of the anode terminal and the cathode terminal being connected to the backside common terminal.

7. The light-emitting element chip according to claim 6, wherein an element for causing a potential drop is connected between the gate electrode of each of the second transfer thyristors and the gate terminal of the corresponding one of the light-emitting thyristors.

8. An image forming apparatus comprising:

a charging unit charging an image carrier;

an exposure unit including a light-emitting element head, the exposure unit exposing the image carrier that has been charged, to form an electrostatic latent image;

a developing unit developing the electrostatic latent image formed on the image carrier; and a transfer unit transferring an image developed on the image carrier onto a transferred body, the light-emitting element head of the exposure unit including:

a plurality of light-emitting element chips in each of which a plurality of transfer elements and a plurality of light-emitting elements are arrayed in a line, the plurality of light-emitting elements being provided corresponding to the plurality of transfer elements;

a lighting signal supply unit for supplying a plurality of lighting signals, each of the plurality of lighting signals corresponding to a respective one of N groups into which the plurality of light-emitting element chips are divided, and being provided to each of the light-emitting element chips that belong to the respective one of the N groups, where N is an integer of 2 or more; and a clock signal supply unit for supplying a first clock signal as a transfer signal for causing the plurality of light-emitting elements of each of the plurality of light-emitting element chips to sequentially emit light, the first clock signal being supplied to each of the plurality of light-emitting element chips in a common manner, and a plurality of second clock signals for setting the plurality of light-emitting elements ready to emit light, the plurality of second clock signals being supplied to respective light-emitting element chips belonging to a said group, and being supplied in a common manner across the N groups, wherein each of the plurality of second clock signals is provided with a plurality of periods falling within a period in which one of the plurality of transfer elements of each of the plurality of light-emitting element chips is kept turned on by the first clock signal, the number of the plurality of periods being determined according to the number of combinations of light emission and non-light emission of the plurality of light-emitting element chips included in each of the N groups, each of the combinations corresponding to a respective one of the plurality of periods, the clock signal supply unit supplies the plurality of second clock signals on the basis of the combinations, such that a transfer element adjacent to a turned-on transfer element in the direction of sequential lighting of the light-emitting elements is set to turn on, and the lighting signal supply unit starts supplying each of the plurality of lighting signals in a period that corresponds to a respective one of the combinations of the light emission and non-light emission of the light-emitting element chips in each of the N groups, among the plurality of periods provided for each of the plurality of second clock signals.

9. A signal supply method for a plurality of light-emitting element chips in each of which a plurality of transfer elements and a plurality of light-emitting elements are arrayed in a line, the plurality of light-emitting elements being provided corresponding to the plurality of transfer elements, the signal supply method comprising:

supplying a plurality of lighting signals, each of the plurality of lighting signals corresponding to a respective one of N groups into which the plurality of light-emitting element chips are divided, and being provided to each of the light-emitting element chips that belong to the respective one of the N groups, where N is an integer of 2 or more; and supplying a first clock signal as a transfer signal for causing the plurality of light-emitting elements of each of the plurality of light-emitting element chips to sequentially emit light, the first clock signal being supplied to each of the plurality of light-emitting element chips in a common manner, and a plurality of second clock signals for setting the plurality of light-emitting elements ready to emit light, the plurality of second clock signals being supplied to respective light-emitting element chips belonging to a said group, and being supplied in a common manner across the N groups, wherein each of the plurality of second clock signals is provided with a plurality of periods falling within a period in which one of the plurality of transfer elements of each of the plurality of light-emitting element chips is kept turned on by the first clock signal, the number of the plurality of periods being determined according to the number of combinations of light emission and non-light emission of the plurality of light-emitting element chips included in each of the N groups, each of the combinations corresponding to a respective one of the plurality of periods, the method comprises supplying the plurality of second clock signals on the basis of the combinations, such that a transfer element adjacent to a turned-on transfer element in a direction of sequential lighting of the light-emitting elements is set to turn on, and the method comprises supplying each of the plurality of lighting signals in a period that corresponds to a respective one of the combinations of the light emission and non-light emission of the light-emitting element chips in each of the N groups, among the plurality of periods provided for each of the plurality of second clock signals.

* * * * *